US006843601B2

(12) United States Patent
Daniels et al.

(10) Patent No.: US 6,843,601 B2
(45) Date of Patent: Jan. 18, 2005

(54) PLASTIC SHOPPING BAG WITH PROMOTIONAL STRIP AD

(76) Inventors: Mark E. Daniels, 250 N. Harbor Dr., Suite 311, Redondo Beach, CA (US) 90277; Joseph L. Wicherski, 240 N. Harbor Dr., Suite 311, Redondo Beach, CA (US) 90277

( * ) Notice: Subject to any disclaimer, the term of this patent is extended or adjusted under 35 U.S.C. 154(b) by 0 days.

(21) Appl. No.: 10/785,585

(22) Filed: Feb. 24, 2004

(65) Prior Publication Data

US 2004/0165795 A1 Aug. 26, 2004

Related U.S. Application Data

(62) Division of application No. 10/346,341, filed on Jan. 17, 2001, now Pat. No. 6,773,162, which is a continuation of application No. 09/897,639, filed on Jun. 29, 2001, now abandoned.

(51) Int. Cl.[7] ..... B65D 30/00
(52) U.S. Cl. ..... 383/127
(58) Field of Search ..... 383/127, 14, 62, 383/77

(56) References Cited

U.S. PATENT DOCUMENTS

| | | | | |
|---|---|---|---|---|
| 1,067,391 | A | 7/1913 | Young | |
| 2,745,593 | A | 5/1956 | Brady | |
| 2,815,620 | A | 12/1957 | Prodigo | |
| 3,744,383 | A | 7/1973 | Finch et al. | |
| 3,806,024 | A | 4/1974 | Marchesani | |
| 3,974,960 | A | 8/1976 | Mitchell | |
| 5,035,515 | A | 7/1991 | Crossman et al. | |
| 5,044,776 | A | 9/1991 | Schramer et al. | |
| 5,369,936 | A | 12/1994 | Callahan et al. | |
| 5,882,118 | A | 3/1999 | Daniels et al. | |
| 6,033,114 | A | 3/2000 | Grimm et al. | |
| 6,536,951 | B1 | 3/2003 | Sill | |
| 6,608,548 | B1 | 8/2003 | Pellaton et al. | |
| 6,773,162 | B2 * | 8/2004 | Daniels et al. | 383/120 |

FOREIGN PATENT DOCUMENTS

| | | | | |
|---|---|---|---|---|
| GB | 1067391 | * | 5/1967 | 383/62 |

* cited by examiner

*Primary Examiner*—Jes F. Pascua
(74) *Attorney, Agent, or Firm*—David A. Belasco; Belasco Jacobs & Townsley, LLP

(57) ABSTRACT

Plastic shopping bags having attached promotional ad strips are described. In bags have gusseted side edges the ad strips are attached within or above the gussets either by heat sealing the strip to the bottom seal and adhering the other end of the strip at the upper end of the bag or adhering the strip to the bag at both ends. In non-gusseted bags, the strips are either heat sealed to the bottom seal and adhered to the upper end of the bag or the strips are adhered at both ends to the front or rear surfaces of the bag. In gusseted T-shirt type handle bags, the intermediate portion of the ad strip is adhered to either the inside or the outside of the gusset. The strips include promotional advertising on at least one surface and include perforations allowing the advertising to be removed from the remainder of the strip.

5 Claims, 12 Drawing Sheets

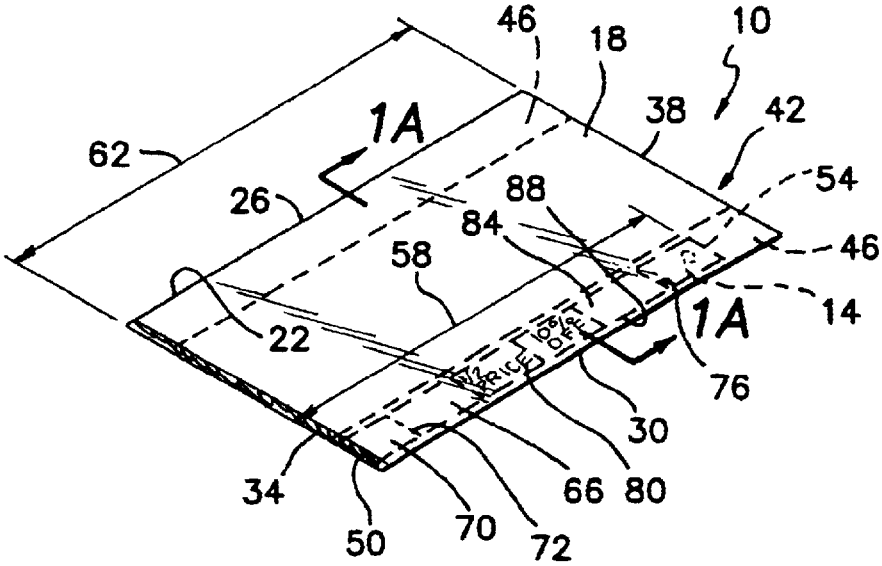
FIG. 1
FIG. 1A
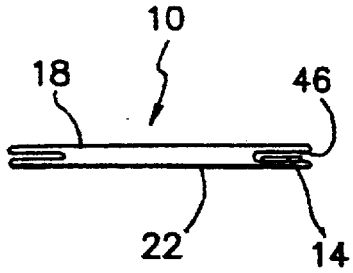
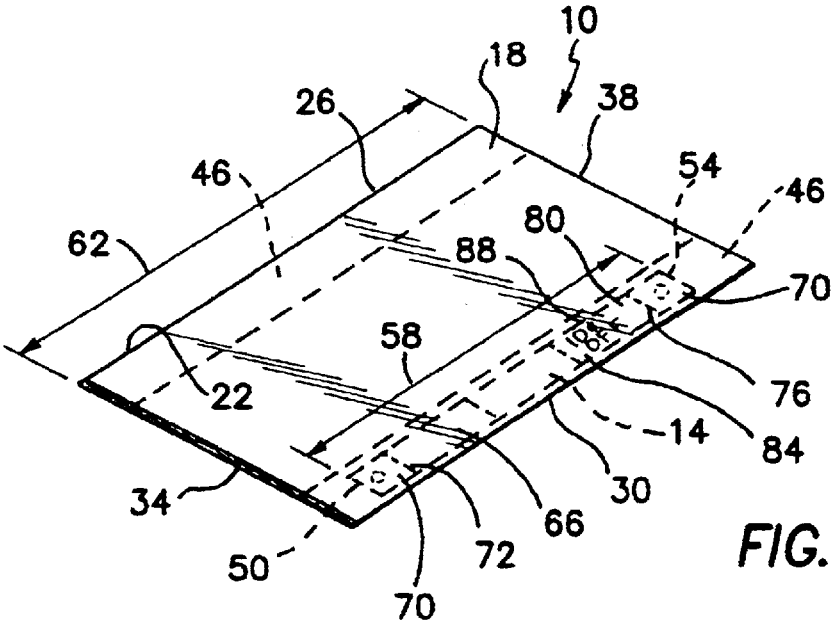
FIG. 3

PLASTIC SHOPPING BAG WITH PROMOTIONAL STRIP AD

RELATED APPLICATION

The instant application is a Divisional application of application Ser. No. 10/346,341 filed Jan. 17, 2003, now U.S. Pat. No. 6,773,162, which is a Continuation of application Ser. No. 09/897,639 filed Jun. 29, 2001, now abandoned. No new matter has been added.

FIELD OF THE INVENTION

This invention relates to the field of plastic bags of the type employed by retailers in packing food items and other merchandise, with particular application to bags that are unsealed or partially sealed along their top edges and include a promotional strip attached to the bag.

BACKGROUND OF THE INVENTION

In our prior U.S. Pat. No. 5,882,118 and its divisional method U.S. Pat. No. 6,068,584, we disclosed and claimed the attachment of advertising strips to T-shirt bags and a method for accomplishing such attachments during the course of fabricating such bags from extruded plastic tubing. Because the bags disclosed in our prior patent were heat-sealed along both their bottom and top edges, it was possible simultaneously to heat seal the ends of advertising strips to be attached to the bag along both the top and lower edges of such strips. These strips could be disposed either within the gussets of the bags or along an outside edge.

Attachment of advertising strips in the manner disclosed in our prior patents, however, cannot be accomplished where the top edges of the bag, such as those sometimes referred to as handle bags, flat bags and merchandise bags are left open at their top edges in order to enable merchandise to be placed in the bag. One type of such bags may have a central handle in contrast to the side handles of the T-shirt bags. When such open top edge bags are being produced, it is not possible to drop heating elements on each side of the cutting blade, transversely along the bag's division line and simultaneously heat seal the bottom of one bag and the top of the adjacent bag with the upper end of the advertising strip since the top edges of each bag must remain open. If it is, therefore, desired to provide open top edge bags with advertising strips, it is necessary to find some means and/or method for attaching the upper end of the advertising strip to the sides of one or both of the bag walls.

When advertising strips are attached to shopping bags there is sometimes a problem of movement of the strips with respect to the bags when the strips are secured only at the strip ends. For this reason it is necessary to develop methods for securing the strip to the bag walls between the strip ends.

SUMMARY OF THE INVENTION (1) A plastic shopping bag with promotional strip ad may be formed from the following components. A pair of registering front and back walls is provided. The walls are secured together along their side and bottom edges and open across at least a portion of their top edges. The walls, when pulled apart from each other, defining a space into which articles may be placed. At least one of the secured together side edges is gusseted.

A plastic strip is located within the gusset. The strip has a first end and a second end and is of a length not greater than a length of the gusseted side edge. The first end of the strip is heat sealed to the bottom edges of the bag walls and the second end of the strip is adhered in the vicinity of the top edges of the bag walls. A portion of the strip between its first and second ends is removably attached to a remainder of the strip.

(2) In a variant of the invention the portion of the strip between its first and second ends is removably attached to the remainder of the strip with at least two perforation lines.

(3) In another variation, promotional material is printed upon at least an upper surface or a lower surface of the portion of the strip between its first and second ends that is removably attached to the remainder of the strip.

(4) In still another variant, a plastic strip is located along one side of a gusset. The strip has a first end and a second end and is of a length not greater than a length of a gusseted side edge. The first end of the strip is heat sealed to the bottom edges of the bag walls and the second end of the strip is adhered in the vicinity of the top edges of the bag walls. A portion of the strip between its first and second ends is removably attached to a remainder of the strip.

(5) In a variant of the invention the portion of the strip between its first and second ends is removably attached to the remainder of the strip with at least two perforation lines.

(6) In another variation, promotional material is printed upon at least an upper surface or a lower surface of the portion of the strip between its first and second ends that is removably attached to the remainder of the strip.

(7) In a further variant, a plastic strip is located within a gusset. The strip has a first end and a second end and is of a length not greater than a length of a gusseted side edge. The first end of the strip is adhered adjacent the bottom edges of the bag walls and the second end of the strip is adhered in the vicinity of the top edges of the bag walls. A portion of the strip between its first and second ends is removably attached to a remainder of the strip.

(8) In a variant of the invention the portion of the strip between its first and second ends is removably attached to the remainder of the strip with at least two perforation lines.

(9) In another variation, promotional material is printed upon at least an upper surface or a lower surface of the portion of the strip between its first and second ends that is removably attached to the remainder of the strip.

(10) In still a further variant, a plastic strip is located along one side of a gusset. The strip has a first end and a second end and is of a length not greater than a length of a gusseted side edge. The first end of the strip is adhered adjacent the bottom edges of the bag walls and the second end of the strip is adhered in the vicinity of the top edges of the bag walls. A portion of the strip between its first and second ends is removably attached to a remainder of the strip.

(11) In a variant of the invention the portion of the strip between its first and second ends is removably attached to the remainder of the strip with at least two perforation lines.

(12) In another variation, promotional material is printed upon at least an upper surface or a lower surface of the portion of the strip between its first and second ends that is removably attached to the remainder of the strip.

(13) In yet a further variant of the invention, a plastic strip is located upon at least one of the front and back walls between the side edges. The strip has a first end and a second end and is of a length not greater than the length of the walls. The first end of the strip is heat sealed to the bottom edges of the bag walls and the second end of the strip is adhered in the vicinity of the top edges of the bag walls. A portion of the strip between its first and second ends is removably attached to a remainder of the strip.

(14) In a variant of the invention the portion of the strip between its first and second ends is removably attached to the remainder of the strip with at least two perforation lines.

(15) In another variation, promotional material is printed upon at least an upper surface or a lower surface of the portion of the strip between its first and second ends that is removably attached to the remainder of the strip.

(16) In another variant, a plastic strip is located upon at least one of front and back walls between the side edges. The strip has a first end and a second end and is of a length not greater than the length of the walls. The first end of the strip is adhered adjacent the bottom edges of the bag walls and the second end of the strip is adhered in the vicinity of the upper edges of the bag walls. A portion of the strip between its first and second ends is removably attached to a remainder of the strip.

(17) In a variant of the invention the portion of the strip between its first and second ends is removably attached to the remainder of the strip with at least two perforation lines.

(18) In another variation, promotional material is printed upon at least an upper surface or a lower surface of the portion of the strip between its first and second ends that is removably attached to the remainder of the strip.

(19) In still another variant, the secured together first and second side edges are folded inwardly from the front and back walls to form a pair of gussets. The gussets have top and bottom edges. The top edges of the front wall, the back wall, and the gussets terminate in an upper seam. The bottom edges of the front wall, the back wall, and the gussets terminate in a lower seam. The lower seam is perpendicular to the side edges of the front and back walls.

A U-shaped cut-out is located in an upper portion of the bag. The cut-out commences at a first point along the upper seam spaced inwardly from the first side edge. The cut-out extends to a second point along the upper seam spaced inwardly from the second side edge. The cut-out extends downwardly toward the lower seam, forming an open mouth and a pair of bag handles.

A plastic strip is located within at least one gusset. The strip has a first end and a second end and is of a length not greater than the length of the gusset. The first end of the strip is heat sealed to the lower seam and the second end of the strip is heat sealed to the upper seam. The strip is adhered to the gusset between the first end and the second end of the strip. A portion of the strip between its first and second ends is removably attached to a remainder of the strip.

(20) In a variant of the invention the portion of the strip between its first and second ends is removably attached to the remainder of the strip with at least two perforation lines.

(21) In another variation, promotional material is printed upon at least an upper surface or a lower surface of the portion of the strip between its first and second ends that is removably attached to the remainder of the strip.

(22) In a final variant, a plastic strip is located upon at least one of the front and back walls above at least one gusset. The strip has a first end and a second end and is of a length not greater than the length of the gusset. The first end of the strip is heat sealed to the lower seam and the second end of the strip is heat sealed to the upper seam. The strip is adhered to one of the front and back walls above at least one gusset between the first end and the second end of the strip. A portion of the strip between its first and second ends is removably attached to a remainder of the strip.

(23) In a variant of the invention the portion of the strip between its first and second ends is removably attached to the remainder of the strip with at least two perforation lines.

(24) In another variation, promotional material is printed upon at least an upper surface or a lower surface of the portion of the strip between its first and second ends that is removably attached to the remainder of the strip.

An apparatus for fabricating plastic shopping bags, is provided. Each of the bags has closed side and bottom edges. At least one side edge is gusseted. The bag has an open top edge. The gusseted side edge includes an upper wall portion and a lower wall portion in abutment with each other. A plastic strip is located between the upper and lower wall portions of the gusseted side edge.

The apparatus includes means for moving extruded flattened and gusseted plastic tubing that has a plastic strip located in the gusset, in a horizontal plane into a cutting station. The station has a horizontal planar blade receiving area over which the flattened tubing is moved to be cut into a series of rectangular blanks. A blade is provided for cutting the tubing transversely at the cutting station.

The tubing is cut at pre-selected points along the tubing length to produce the series of blanks of a predetermined length. The blade is reciprocatable between a first upper poised position, and a second lower cutting position on the planar blade receiving area. The blade is of a length at least as great as the width of the gusseted tubing. The blade has a first side and a second side. The blade further has a cutting edge and carries a heating element on its first side adjacent the cutting edge. The heating element serves to heat seal the cut edge of the tubing including its gusset and enclosed plastic strip portion on the first side of the blade.

A vacuum element is located on the blade's second side also adjacent the cutting edge and above the upper wall portion of the gusseted side edge. The vacuum element, when the blade is lowered to its second position, extends to at least one gusset of the tubing. The vacuum element is located adjacent the portion of the blade edge which, upon the blade being lowered to its second position, cuts through the gusset.

An adhesive injector is located adjacent the side edge of the blade and proximate to the portion of the blade edge carrying the vacuum element. Means are provided for reciprocating the blade between the first and second positions to effect cutting of the tubing at the pre-selected points. Means are provided for producing a vacuum in the vacuum element when the blade is moved to its second position to cut the tubing and abutting plastic strip, at which instant the adjacent area of the upper wall portion of the gusset is momentarily raised from its abutment with the plastic strip.

Means are provided for activating the adhesive injector momentarily to discharge a pre-selected quantity of adhesive between the raised upper wall portion of the gusset and the plastic strip when the vacuum element momentarily lifts the upper wall portion. Means located adjacent the first side of the blade and in line with the raised portion of the gusset are provided, to compress the raised area of the gusset back to the plane of the remaining portion of the cut blank and against the plastic strip.

When the blade is brought down against the tubing to cut it transversely, the heating element on the first side of the blade heat-seals the cut edge of the tubing on the first side of the blade, and the vacuum element on the second side of the blade momentarily lifts an area of the upper wall portion of the gusset adjacent the second side of the blade. The adhesive injector then discharges a pre-selected quantity of adhesive between the raised area of the upper wall portion of the gusset and the cut end of the plastic strip, following which, upon the raising of the blade to its first position, the adhesive receiving upper edge of the gusset is pressed back down against the cut end of the plastic strip to the plane of the remainder of the cut blank.

In a variant of the apparatus, designed for fabricating plastic bags each having an open top edge, at least one gusseted side edge and a plastic strip located along one side of the gusseted side edge, the apparatus includes means for moving flattened plastic tubing in a horizontal plane into a cutting station. The station has a horizontal planar blade receiving area over which the flattened tubing is moved to be cut into a series of rectangular blanks. The tubing is gusseted along at least one side edge and has a plastic strip located along one side of the gusset of the side edge.

A blade is provided for cutting the tubing transversely at pre-selected points along its length to produce the series of blanks. The blade is reciprocatable between a first upper poised position, and a second lower cutting position on the planar blade receiving area. The blade is of a length at least as great as the width of the gusseted tubing. The blade has a first side and a second side. The blade further has a cutting edge and carries a heating element on its first side adjacent the cutting edge and a vacuum element on its second side adjacent the cutting edge.

The heating element serves to heat seal the cut edge of the tubing including its gusset and the plastic strip located along one side of the gusseted side edge on the first side of the blade. The vacuum element, when the blade is lowered to its second position, extends to at least one gusset of the tubing. The vacuum element is located adjacent the portion of the blade edge which, upon the blade being lowered to its second position, cuts through the gusset and abutting plastic strip.

An adhesive injector is located adjacent the side edge of the blade and proximate to the portion of the blade edge carrying the vacuum element. Means are provided for reciprocating the blade between the first and second positions to effect cutting of the tubing at the pre-selected points. Means are provided for producing a vacuum in the vacuum element when the blade is moved to its second position to cut the tubing and abutting plastic strip, at which instant the cut end of the plastic strip is momentarily raised from the side edge of the gusset.

Means are provided for activating the adhesive injector momentarily to discharge a pre-selected quantity of adhesive between the raised plastic strip and the side of the gusset when the vacuum element raises the strip. Means are provided adjacent the first side of the blade and in line with the raised portion of the strip, to compress the raised upper cut end of the strip to the plane of the cut blank.

When the blade is brought down against the tubing to cut it transversely, the heating element on the first side of the blade heat-seals the cut edge of the tubing and the plastic strip on the first side of the blade. Next the vacuum element on the second side of the blade momentarily raises the cut end of the plastic strip adjacent the second side of the blade. At this instant, the adhesive injector discharges a pre-selected quantity of adhesive between the raised cut end of the strip and the side of the gusset, following which, upon the lifting of the blade to its first position, the adhesive receiving cut end of the plastic strip is pressed back down to the plane of the cut blank.

Another variant of the apparatus, is designed for fabricating plastic shopping bags. Each of the bags has closed side and bottom edges, at least one gusseted side edge, and an open top edge. The gusseted side edge includes an upper wall portion and a lower wall portion in abutment with each other, and a plastic strip located between the upper and lower wall portions of the gusseted side edge.

The apparatus includes means for moving extruded flattened and gusseted plastic tubing in a horizontal plane into a cutting station. The station has a horizontal planar blade receiving area over which the flattened tubing is moved to be cut into a series of rectangular blanks. A blade is provided for cutting the tubing transversely at the cutting station at pre-selected points along the tubing length to produce the series of blanks of a predetermined length. The blade is reciprocatable between a first upper poised position, and a second lower cutting position on the planar blade receiving area. The blade is of a length at least as great as the width of the gusseted tubing. The blade has a first side and a second side. The blade further has a cutting edge and carries a heating element on its first side adjacent the cutting edge.

The heating element serves to heat seal the cut edge of the tubing including its gusset on the first side of the blade. A vacuum element is located on its second side also adjacent the cutting edge and above the upper wall portion of the gusseted side edge. The vacuum element, when the blade is lowered to its second position, extends to the gusset of the tubing. The vacuum element is located adjacent the portion of the blade edge which, upon the blade being lowered to its second position, cuts through the tubing. An adhesive injector is located adjacent the side edge of the blade and proximate to the portion of the blade edge carrying the vacuum element.

Means are provided for reciprocating the blade between the first and second positions to effect cutting of the tubing at the pre-selected points. Means are provided for producing a vacuum in the vacuum element when the blade is moved to its second position to cut the tubing at which instant the adjacent area of the upper wall portion of the gusset is momentarily raised from its abutment with the lower wall portion of the gusset.

Means are provided for inserting a plastic strip of predetermined length into the gusset. Means are provided for activating the adhesive injector momentarily to discharge a pre-selected quantity of adhesive in at least two locations between the raised upper wall portion of the gusset and the plastic strip when the vacuum element momentarily lifts the upper wall portion. Means are provided adjacent the first side of the blade and in line with the raised upper portion of the gusset, to compress the raised area of the gusset back to the plane of the remaining portion of the cut blank and against the plastic strip.

When the blade is brought down against the tubing to cut it transversely, the heating element on the first side of the blade heat-seals the cut edge of the tubing on the first side of the blade, and the vacuum element on the second side of the blade momentarily lifts an area of the upper portion of the gusset adjacent the second side of the blade, a plastic strip of predetermined length is inserted into the gusset and the adhesive injector discharges a pre-selected quantity of adhesive between the raised area of the portion of the gusset and at least two locations on the plastic strip. Next, upon the raising of the blade to its first position, the adhesive receiving upper edge of the gusset is pressed back down against the plastic strip to the plane of the remainder of the cut blank.

Yet another variant of the apparatus, is designed for fabricating plastic bags each having an open top edge, at least one gusseted side edge and a plastic strip located along one side of the gusseted side edge. The apparatus includes means for moving flattened plastic tubing in a horizontal plane into a cutting station. The station has a horizontal planar blade receiving area over which the flattened tubing is moved to be cut into a series of rectangular blanks. The tubing is gusseted along at least one side edge.

A blade is provided for cutting the tubing transversely at pre-selected points along its length to produce the series of blanks. The blade is reciprocatable between a first upper poised position, and a second lower cutting position on the planar blade receiving area. The blade is of a length at least as great as the width of the gusseted tubing. The blade has a first side and a second side. The blade further has a cutting edge and carries a heating element on its first side adjacent the cutting edge. The heating element serves to heat seal the cut edge of the tubing including its gusset on the first side of the blade.

An adhesive injector is located adjacent the side edge of the blade. Means are provided for reciprocating the blade between the first and second positions to effect cutting of the tubing at the pre-selected points. Means are provided for activating the adhesive injector momentarily to discharge a pre-selected quantity of adhesive at at least two locations along one side of the gusseted side edge of the bag blank. Means are provided for locating a plastic strip of a predetermined length along one side of the gusseted side edge of the bag blank over the discharged adhesive. Means are provided adjacent the first side of the blade and in line with the plastic strip, to compress the strip to the gusseted side edge of the bag blank.

When the blade is brought down against the tubing to cut it transversely, the heating element on the first side of the blade heat-seals the cut edge of the tubing on the first side of the blade. Next, the adhesive injector discharges a pre-selected quantity of adhesive at at least two locations along one side of the gusseted side edge of the bag blank. Next, a plastic strip of a predetermined length is located along one side of the gusseted side edge of the bag blank over the discharged adhesive, and the plastic strip is compressed to the gusseted side edge of the bag blank.

Yet another variant of the apparatus, is designed for fabricating plastic bags each having an open top edge and a plastic strip disposed upon at least one of the front and back walls between the side edges. The apparatus includes means for moving flattened plastic tubing in a horizontal plane into a cutting station. The station has a horizontal planar blade receiving area over which the flattened tubing is moved to be cut into a series of rectangular blanks. The tubing has a plastic strip disposed upon at least one of the front and back walls between the side edges.

A blade is provided for cutting the tubing transversely at pre-selected points along its length to produce the series of blanks. The blade is reciprocatable between a first upper poised position, and a second lower cutting position on the planar blade receiving area. The blade is of a length at least as great as the width of the tubing. The blade has a first side and a second side. The blade further has a cutting edge and carries a heating element on its first side adjacent the cutting edge and a vacuum element on its second side adjacent the cutting edge. The heating element serves to heat seal the cut edge of the tubing and the plastic strip disposed upon at least one of the front and back walls between the side edges on the first side of the blade.

The vacuum element, when the blade is lowered to its second position, extends to the side edges of the tubing. The vacuum element is located adjacent the portion of the blade edge which, upon the blade being lowered to its second position, cuts through the tubing and abutting plastic strip. An adhesive injector is located adjacent the side edge of the blade and proximate to the portion of the blade edge carrying the vacuum element. Means are provided for reciprocating the blade between the first and second positions to effect cutting of the tubing at the pre-selected points.

Means are provided for producing a vacuum in the vacuum element when the blade is moved to its second position to cut the tubing and abutting plastic strip, at which instant the cut end of the plastic strip is momentarily raised from either of the front and back walls. Means are provided for activating the adhesive injector momentarily to discharge a pre-selected quantity of adhesive between the raised plastic strip and either of the front and back walls when the vacuum element raises the strip. Means are provided adjacent the first side of the blade and in line with the raised portion of the strip, to compress the raised upper cut end of the strip to the plane of the cut blank.

When the blade is brought down against the tubing to cut it transversely, the heating element on the first side of the blade heat-seals the cut edge of the tubing and the plastic strip on the first side of the blade, and the vacuum element on the second side of the blade momentarily raises the cut end of the plastic strip adjacent the second side of the blade. At this instant, the adhesive injector discharges a pre-selected quantity of adhesive between the raised cut end of the strip and either of the front and back walls. Next, upon the lifting of the blade to its first position, the adhesive receiving cut end of the plastic strip is pressed back down to the plane of the cut blank.

Still another variant of the apparatus, is designed for fabricating plastic bags each having an open top edge and a plastic strip upon at least one of the front and back walls between the side edges. The apparatus includes means for moving flattened plastic tubing in a horizontal plane into a cutting station. The station has a horizontal planar blade receiving area over which the flattened tubing is moved to be cut into a series of rectangular blanks.

A blade is provided for cutting the tubing transversely at pre-selected points along its length to produce the series of blanks. The blade is reciprocatable between a first upper poised position, and a second lower cutting position on the planar blade receiving area. The blade is of a length at least as great as the width of the tubing. The blade has a first side and a second side. The blade further has a cutting edge and carries a heating element on its first side adjacent the cutting edge.

The heating element serves to heat seal the cut edge of the tubing on the first side of the blade. An adhesive injector is located adjacent the side edge of the blade. Means are provided for reciprocating the blade between the first and second positions to effect cutting of the tubing at the pre-selected points. Means are provided for activating the adhesive injector momentarily to discharge a pre-selected quantity of adhesive at at least two locations upon at least one of the front and back walls between the side edges of the bag blank.

Means are provided for locating a plastic strip of a predetermined length upon at least one of the front and back walls between the side edges of the bag blank over the discharged adhesive. Means are provided adjacent the first side of the blade and in line with the plastic strip, to compress the strip to either of the front and back walls of the bag blank.

When the blade is brought down against the tubing to cut it transversely, the heating element on the first side of the blade heat-seals the cut edge of the tubing on the first side of the blade. Next, the adhesive injector discharges a pre-selected quantity of adhesive at at least two locations upon at least one of the front and back walls between the side edges of the bag blank. Next, a plastic strip of a predetermined length is located upon at least one of the front and back walls between the side edges of the bag blank over the discharged adhesive. The plastic strip is then compressed to the wall of the bag blank.

A further variant of the apparatus, is designed for fabricating plastic bags each having closed side and bottom edges, first and second side gussets, a partially open top edge, and a pair of bag handles terminating at the top edge. The gussets are comprised of an upper wall portion and a lower wall portion in abutment with each other. A plastic strip is located between the upper and lower wall portions of at least one gusset.

The apparatus includes means for moving extruded flattened and gusseted plastic tubing having a plastic strip disposed in at least one of the gussets, in a horizontal plane into a cutting station. The station has a horizontal planar blade receiving area over which the flattened tubing is moved to be cut into a series of rectangular blanks.

A blade is provided for cutting the tubing transversely at the cutting station at pre-selected points along the tubing length to produce the series of blanks of a predetermined length. The blade is reciprocatable between a first upper poised position, and a second lower cutting position on the planar blade receiving area. The blade is of a length at least as great as the width of the gusseted tubing. The blade has a first side and a second side. The blade further has a cutting edge and carries first and second heating elements on its first and second sides adjacent the cutting edge. The heating elements serve to heat seal the cut bottom and top edges of the bag including its gussets and enclosed plastic strip on the first and second sides of the blade.

A vacuum element is located on the second side of the blade and spaced from the second heating element and above the upper wall portion of the gusseted side edge. The vacuum element, when the blade is lowered to its second position, extends to at least one gusset of the tubing. An adhesive injector is located adjacent the side edge of the blade and proximate to the portion of the blade edge carrying the vacuum element. Means are provided for reciprocating the blade between the first and second positions to effect cutting of the tubing at the pre-selected points.

Means are provided for producing a vacuum in the vacuum element when the blade is moved to its second position to cut the tubing and abutting plastic strip, at which instant the adjacent area of the upper wall portion of the gusset is momentarily raised from its abutment with the plastic strip. Means are provided for activating the adhesive injector momentarily to discharge a pre-selected quantity of adhesive in at least two locations between the raised upper wall portion of the gusset and the plastic strip when the vacuum element momentarily lifts the upper wall portion. Means are provided adjacent the first side of the blade and in line with the raised upper portion of the gusset, to compress the raised area of the gusset back to the plane of the remaining portion of the cut blank and against the plastic strip.

Means are provided for cutting a U-shaped cut-out commencing at the sealed top edge of the bag blank and extending downwardly toward the bottom edge of the blank.

When the blade is brought down against the tubing to cut it transversely, the heating elements on the first and second sides of the blade heat seal the cut bottom and top edges of the bag and the plastic strip on the first and second sides of the blade, and the vacuum element on the second side of the blade momentarily lifts an area of the upper portion of the gusset spaced from the second side of the blade. The adhesive injector then discharges a pre-selected quantity of adhesive in at least two locations between the raised area of the upper portion of the gusset and a portion of the plastic strip between its first and second ends. Next, upon the raising of the blade to its first position, the raised upper portion of the gusset is pressed back down against the plastic strip to the plane of the cut blank, a U-shaped cut-out is then cut in the bag blank commencing at the sealed top edge and extending downwardly toward the bottom edge, thus yielding an open mouth and a pair of bag handles.

Another variant of the apparatus, is designed for fabricating plastic bags each having front and rear outer surfaces, closed side and bottom edges, first and second side gussets, a partially open top edge, and a pair of bag handles terminating at the top edge. The gussets are comprised of an upper wall portion and a lower wall portion in abutment with each other. A plastic strip disposed upon at least one of the front and rear outer surfaces above at least one gusset.

The apparatus includes means for moving extruded flattened and gusseted plastic tubing in a horizontal plane into a cutting station. The tubing has a plastic strip located upon at least one of the front and rear outer surfaces above at least one gusset. The station has a horizontal planar blade receiving area over which the flattened tubing is moved to be cut into a series of rectangular blanks.

A blade is provided for cutting the tubing transversely at the cutting station at pre-selected points along the tubing length to produce the series of blanks of a predetermined length. The blade is reciprocatable between a first upper poised position, and a second lower cutting position on the planar blade receiving area. The blade is of a length at least as great as the width of the gusseted tubing. The blade has a first side and a second side. The blade further has a cutting edge and carries first and second heating elements on its first and second sides adjacent the cutting edge. The heating elements serve to heat seal the cut bottom and top edges of the bag including its gussets and the plastic strip on the first and second sides of the blade.

A vacuum element is located on the second side of the blade and spaced from the second heating element and above the upper wall portion of the gusseted side edge. The vacuum element, when the blade is lowered to its second position, extending to at least one gusset of the tubing. An adhesive injector is located adjacent the side edge of the blade and proximate to the portion of the blade carrying the vacuum element. Means are provided for reciprocating the blade between the first and second positions to effect cutting of the tubing at the pre-selected points. Means are provided for producing a vacuum in the vacuum element when the blade is moved to its second position to cut the tubing and abutting plastic strip. At this instant a portion of the plastic strip disposed above the gusset is momentarily raised from its abutment with either of the front and rear outer surfaces.

Means are provided for activating the adhesive injector momentarily to discharge a pre-selected quantity of adhesive in at least two locations between the raised portion of the plastic strip and either of the front and rear outer surfaces when the vacuum element momentarily lifts the portion of the plastic strip. Means are provided adjacent the first side of the blade and in line with the gusset, to compress the raised portion of the plastic strip back to the plane of the cut blank. Means are provided for cutting a U-shaped cut-out commencing at the sealed top edge of the bag and extending downwardly toward the bottom edge of the bag.

When the blade is brought down against the tubing to cut it transversely, the heating elements on the first and second sides of the blade heat seal the cut bottom and top edges of the bag and the plastic strip on the first and second sides of the blade. Next, the vacuum element on the second side of the blade momentarily lifts a portion of the plastic strip spaced from the second side of the blade, and the adhesive injector discharges a pre-selected quantity of adhesive in at least two locations between the raised portion of the plastic strip between its first and second end and either of the front and rear outer surfaces. Next, upon the raising of the blade to its first position, the raised portion of the plastic strip is pressed back down to the plane of the cut blank, a U-shaped cut-out is then cut in the bag blank commencing at the sealed top edge and extending downwardly toward the bottom edge, thus yielding an open mouth and a pair of bag handles.

Still another variant of the apparatus is designed for fabricating plastic shopping bags each having closed side and bottom edges, at least one gusseted side edge, and an open top edge. The at least one gusseted side edge is comprised of an upper wall portion and a lower wall portion in abutment with each other, and a plastic strip located between the upper and lower wall portions of the gusseted side edge.

The apparatus includes a roll of plastic strip material. The strip material has parallel first and second side edges and is mounted in an unwind stand. Means are provided for unrolling the roll of plastic strip material from the unwind stand. A cold adhesive applicator is provided. The applicator is located to apply either a continuous or non-continuous bead of cold adhesive between the first and second side edges of the plastic strip material. Means are provided for activating the cold adhesive applicator as the plastic strip material is unrolled from the unwind stand.

Means are provided for opening a gusset in extruded flattened and gusseted plastic tubing and feeding the plastic strip material with applied cold adhesive into the gusset. Means are provided for closing the gusset with the plastic strip material located therein and compressing the plastic strip material against the upper wall portion and the lower wall portion of the gusset, thereby adhering the strip material to the upper or lower wall portions.

Means are provided for moving the plastic tubing in a horizontal plane into a cutting station. The station has a horizontal planar blade receiving area over which the flattened tubing is moved to be cut into a series of rectangular blanks. A blade is provided for cutting the tubing transversely at the cutting station at pre-selected points along the tubing length to produce the series of blanks of a predetermined length. The blade is reciprocatable between a first upper poised position, and a second lower cutting position on the planar blade receiving area. The blade is of a length at least as great as the width of the gusseted tubing. The blade has a first side and a second side. The blade has a cutting edge and carries a heating element on its first side adjacent the cutting edge.

The heating element serves to heat seal the cut edge of the tubing including its gusset and enclosed plastic strip material on the first side of the blade. Means are provided for reciprocating the blade between the first and second positions to effect cutting of the tubing at the pre-selected points.

When the plastic strip material is located in the opened gusset, the gusset is then closed and the upper and lower wall portions compressed against the strip material. The blade is then brought down against the tubing to cut it transversely, the heating element on the first side of the blade heat-seals the cut edge of the tubing on the first side of the blade, leaving an openable bag mouth on the second side of the blade. The plastic strip material will thus be heat sealed into the bottom edge of the bag and the strip material will be adhered within the gusset.

A further variant of the apparatus is designed for fabricating plastic bags, each having an open top edge, at least one gusseted side edge and a plastic strip located along one side of the gusseted side edge. The apparatus includes a roll of plastic strip material, the strip material has parallel first and second side edges and is mounted in an unwind stand. Means are provided for unrolling the roll of plastic strip material from the unwind stand. A cold adhesive applicator is provided. The applicator is located to apply a continuous or non-continuous bead of cold adhesive between the first and second side edges of the plastic strip material. Means are provided for activating the cold adhesive applicator as the plastic strip material is unrolled from the unwind stand.

Means are provided for locating the plastic strip material with applied cold adhesive along one side of a gusseted side edge of extruded flattened and gusseted plastic tubing. Means are provided for compressing the plastic strip material against the tubing thereby adhering the strip material to the tubing adjacent the gusseted side edge. Means are provided for moving flattened plastic tubing in a horizontal plane into a cutting station. The station has a horizontal planar blade receiving area over which the flattened tubing is moved to be cut into a series of rectangular blanks.

A blade is provided for cutting the tubing transversely at pre-selected points along its length to produce the series of blanks. The blade is reciprocatable between a first upper poised position, and a second lower cutting position on the planar blade receiving area. The blade is of a length at least as great as the width of the gusseted tubing. The blade has a first side and a second side. The blade further has a cutting edge and carries a heating element on its first side adjacent the cutting edge. The heating element serves to heat seal the cut edge of the tubing including its gusset and the plastic strip material located along one side of the gusseted side edge on the first side of the blade. Means are provided for reciprocating the blade between the first and second positions to effect cutting of the tubing at the pre-selected points.

When the plastic strip material is located along one side of the gusseted side edge and the plastic strip material is compressed against the tubing along one side of the gusseted side edge and the blade is brought down against the tubing to cut it transversely, the heating element on the first side of the blade heat-seals the cut edge of the tubing on the first side of the blade, leaving an openable bag mouth on the second side of the blade, the plastic strip material will be heat sealed into the bottom edge of the bag and the strip material will be adhered above the gusset.

Yet another variant of the apparatus is designed for fabricating plastic shopping bags each having closed side and bottom edges, at least one gusseted side edge, and an open top edge. The at least one gusseted side edge is comprised of an upper wall portion and a lower wall portion in abutment with each other, with a plastic strip located between the upper and lower wall portions of the gusseted side edge. The apparatus includes a roll of plastic strip material. The strip material has parallel first and second side edges and is mounted in an unwind stand. Means are provided for unrolling the roll of plastic strip material from the unwind stand. A cold adhesive applicator is provided.

The applicator is located to apply a continuous or non-continuous bead of cold adhesive between the first and second side edges of the plastic strip material. Means are provided for activating the cold adhesive applicator as the plastic strip material is unrolled from the unwind stand.

Means are provided for opening a gusset in extruded flattened and gusseted plastic tubing and inserting plastic strip material of a predetermined length with applied cold adhesive into the gusset. Means are provided for closing the gusset with the plastic strip material located therein and compressing the plastic strip material against the upper wall portion and the lower wall portion of the gusset, thereby adhering the strip material to either of the upper and lower wall portions.

Means are provided for moving extruded flattened and gusseted plastic tubing in a horizontal plane into a cutting station. The station has a horizontal planar blade receiving area over which the flattened tubing is moved to be cut into a series of rectangular blanks. A blade is provided for cutting the tubing transversely at the cutting station at pre-selected points along the tubing length to produce the series of blanks of a predetermined length. The blade is reciprocatable between a first upper poised position, and a second lower cutting position on the planar blade receiving area. The blade is of a length at least as great as the width of the gusseted tubing. The blade has a first side and a second side. The blade has a cutting edge and carries a heating element on its first side adjacent the cutting edge.

The heating element serves to heat seal the cut edge of the tubing including its gusset on the first side of the blade. Means are provided for reciprocating the blade between the first and second positions to effect cutting of the tubing at the pre-selected points. When the predetermined length of plastic strip material is located in the opened gusset and the gusset is then closed and the upper and lower wall portions compressed against the strip material and the blade is brought down against the tubing to cut it transversely, the heating element on the first side of the blade heat-seals the cut edge of the tubing on the first side of the blade, leaving an openable bag mouth on the second side of the blade, the plastic strip material will be adhered within the gusset.

Yet a further apparatus is designed for fabricating plastic bags each having an open top edge, at least one gusseted side edge and a plastic strip located along one side of the gusseted side edge. The apparatus includes a roll of plastic strip material. The strip material has parallel first and second side edges and is mounted in an unwind stand. Means are provided for unrolling the roll of plastic strip material from the unwind stand. A cold adhesive applicator is provided. The applicator is located to apply either a continuous or non-continuous bead of cold adhesive between the first and second side edges of the plastic strip material. Means are provided for activating the cold adhesive applicator as the plastic strip material is unrolled from the unwind stand.

Means are provided for locating plastic strip material of a predetermined length with applied cold adhesive along one side of a gusseted side edge of extruded flattened and gusseted plastic tubing. Means are provided for compressing the plastic strip material against the tubing thereby adhering the strip material adjacent the gusseted side edge. Means are provided for moving flattened plastic tubing in a horizontal plane into a cutting station. The station has a horizontal planar blade receiving area over which the flattened tubing is moved to be cut into a series of rectangular blanks. The tubing is gusseted along at least one side edge.

A blade is provided for cutting the tubing transversely at pre-selected points along its length to produce the series of blanks. The blade is reciprocatable between a first upper poised position, and a second lower cutting position on the planar blade receiving area. The blade is of a length at least as great as the width of the gusseted tubing. The blade has a first side and a second side, the blade further has a cutting edge and carries a heating element on its first side adjacent the cutting edge. The heating element serving to heat seal the cut edge of the tubing including its gusset on the first side of the blade.

When the plastic strip material is located along one side of the gusseted side edge and the plastic strip material is compressed against the tubing and the blade is brought down against the tubing to cut it transversely, the heating element on the first side of the blade heat-seals the cut edge of the tubing on the first side of the blade, leaving an openable bag mouth on the second side of the blade, the plastic strip material will be adhered above the gusset.

Still a further variant of an apparatus is designed for fabricating plastic bags each having an open top edge and a plastic strip located upon at least one of the front and back walls between the side edges. The apparatus includes a roll of plastic strip material. The strip material has parallel first and second side edges and is mounted in an unwind stand. Means are provided for unrolling the roll of plastic strip material from the unwind stand. A cold adhesive applicator is provided. The applicator is located to apply either a continuous or non-continuous bead of cold adhesive between the first and second side edges of the plastic strip material. Means are provided for activating the cold adhesive applicator as the plastic strip material is unrolled from the unwind stand. Means are provided for locating plastic strip material with applied cold adhesive upon either of front and back walls and between side edges of extruded flattened plastic tubing. Means are provided for compressing the plastic strip material against either the front or back walls thereby adhering the strip material to either of the walls.

Means are provided for moving flattened plastic tubing in a horizontal plane into a cutting station. The station has a horizontal planar blade receiving area over which the flattened tubing is moved to be cut into a series of rectangular blanks. The tubing has a plastic strip located upon at least one of the front and back walls between the side edges.

A blade is provided for cutting the tubing transversely at pre-selected points along its length to produce the series of blanks. The blade is reciprocatable between a first upper poised position, and a second lower cutting position on the planar blade receiving area. The blade is of a length at least as great as the width of the tubing. The blade has a first side and a second side. The blade further has a cutting edge and carries a heating element on its first side adjacent the cutting edge.

The heating element serves to heat seal the cut edge of the tubing and the plastic strip material located upon at least one of the front and back walls between the side edges on the first side of the blade. Means are provided for reciprocating the blade between the first and second positions to effect cutting of the tubing at the pre-selected points.

When the plastic strip material is located upon either of the front and back walls between the side edges of the tubing and the plastic strip material is compressed against the tubing and the blade is brought down against the tubing to cut it transversely, the heating element on the first side of the blade heat-seals the cut edge of the tubing on the first side of the blade, leaving an openable bag mouth on the second side of the blade, the plastic strip material will be heat sealed into the bottom edge of the bag and the strip material will be adhered to either of the front and back walls.

Another variant of an apparatus is designed for fabricating plastic bags each having an open top edge and a plastic strip upon at least one of the front and back walls between the side edges. The apparatus includes a roll of plastic strip material. The strip material has parallel first and second side edges and is mounted in an unwind stand. Means are provided for unrolling the roll of plastic strip material from the unwind stand. A cold adhesive applicator is provided. The applicator is located to apply either a continuous or non-continuous bead of cold adhesive between the first and second side edges of the plastic strip material. Means for activating the cold adhesive applicator as the plastic strip material is unrolled from the unwind stand.

Means are provided for locating plastic strip material of a predetermined length with applied cold adhesive upon either front or back walls and between side edges of extruded flattened plastic tubing. Means are provided for compressing the plastic strip material against either the front or back walls thereby adhering the strip material to either of the walls. Means are provided for moving flattened plastic tubing in a horizontal plane into a cutting station. The station has a horizontal planar blade receiving area over which the flattened tubing is moved to be cut into a series of rectangular blanks.

A blade is provided for cutting the tubing transversely at pre-selected points along its length to produce the series of blanks. The blade is reciprocatable between a first upper poised position, and a second lower cutting position on the planar blade receiving area. The blade is of a length at least as great as the width of the tubing. The blade has a first side and a second side. The blade further has a cutting edge and carries a heating element on its first side adjacent the cutting edge. The heating element serves to heat seal the cut edge of the tubing on the first side of the blade.

When the plastic strip material is located upon either of the front and back walls between the side edges and the plastic strip material is compressed against the tubing and the blade is brought down against the tubing to cut it transversely, the heating element on the first side of the blade heat-seals the cut edge of the tubing on the first side of the blade, leaving an openable bag mouth on the second side of the blade, the plastic strip material will be adhered to either of the front and back walls.

Still another variant of an apparatus is designed for fabricating plastic shopping bags each having closed side and bottom edges, first and second side gussets, a partially open top edge, and a pair of bag handles terminating at the top edge. The gussets are comprised of an upper wall portion and a lower wall portion in abutment with each other. A plastic strip is located between the upper and lower wall portions of at least one gusset.

The apparatus includes a roll of plastic strip material. The strip material has parallel first and second side edges and is mounted in an unwind stand. Means are provided for unrolling the roll of plastic strip material from the unwind stand. A cold adhesive applicator is provided. The applicator is located to apply either a continuous or non-continuous bead of cold adhesive between the first and second side edges of the plastic strip material. Means are provided for activating the cold adhesive applicator as the plastic strip material is unrolled from the unwind stand. Means are provided for opening a gusset in extruded flattened and gusseted plastic tubing and feeding the plastic strip material with applied cold adhesive into the gusset. Means are provided for closing the gusset with the plastic strip material located therein and compressing the plastic strip material against the upper wall portion and the lower wall portion of the gusset, thereby adhering the strip material to either of the upper and lower wall portions.

Means are provided for moving extruded flattened and gusseted plastic tubing having plastic strip material located in at least one of the gussets, in a horizontal plane into a cutting station. The station has a horizontal planar blade receiving area over which the flattened tubing is moved to be cut into a series of rectangular blanks.

A blade is provided for cutting the tubing transversely at the cutting station at pre-selected points along the tubing length to produce the series of blanks of a predetermined length. The blade is reciprocatable between a first upper poised position, and a second lower cutting position on the planar blade receiving area. The blade is of a length at least as great as the width of the gusseted tubing. The blade has a first side and a second side. The blade further has a cutting edge and carries first and second heating elements on its first and second sides adjacent the cutting edge.

The heating elements serve to heat seal the cut bottom and top edges of the bag including its gussets and enclosed plastic strip material on the first and second sides of the blade. Means are provided for reciprocating the blade between the first and second positions to effect cutting of the tubing at the pre-selected points. Means are provided for cutting a U-shaped cut-out commencing at the sealed top edge of the bag blank and extending downwardly toward the bottom edge of the blank.

When the plastic strip material is located in the opened gusset and the gusset is then closed and the upper and lower wall portions compressed against the strip material and when the blade is brought down against the tubing to cut it transversely, the heating elements on the first and second sides of the blade heat seal the cut bottom and top edges of the bag and the plastic strip on the first and second sides of the blade, the plastic strip material will be heat sealed into the top and bottom edges of the bag and the strip material will be adhered within the gusset, a U-shaped cut-out is then cut in the bag blank commencing at the sealed top edge and extending downwardly toward the bottom edge, thus yielding an open mouth and a pair of bag handles.

A final variant of an apparatus is designed for fabricating plastic shopping bags each having front and rear outer surfaces, closed side and bottom edges, first and second side gussets, a partially open top edge, and a pair of bag handles terminating at the top edge. The gussets are comprised of an upper wall portion and a lower wall portion in abutment with each other, and a plastic strip located upon at least one of the front and rear outer surfaces above at least one gusset.

The apparatus includes a roll of plastic strip material. The strip material has parallel first and second side edges and is mounted in an unwind stand. Means are provided for unrolling the roll of plastic strip material from the unwind stand. A cold adhesive applicator is provided. The applicator is located to apply either a continuous or non-continuous bead of cold adhesive between the first and second side edges of the plastic strip material. Means are provided for activating the cold adhesive applicator as the plastic strip material is unrolled from the unwind stand.

Means are provided for locating the plastic strip material with applied cold adhesive along one side of a gusseted side edge of extruded flattened and gusseted plastic tubing. Means are provided for compressing the plastic strip material against the tubing thereby adhering the strip material adjacent the gusseted side edge.

Means are provided for moving extruded flattened and gusseted plastic tubing having plastic strip material located upon at least one of the front and rear outer surfaces above at least one gusset, in a horizontal plane into a cutting station, the station having a horizontal planar blade receiving area over which the flattened tubing is moved to be cut into a series of rectangular blanks.

A blade is provided for cutting the tubing transversely at the cutting station at pre-selected points along the tubing length to produce the series of blanks of a predetermined length. The blade is reciprocatable between a first upper poised position, and a second lower cutting position on the planar blade receiving area. The blade is of a length at least as great as the width of the gusseted tubing. The blade has a first side and a second side. The blade further has a cutting edge and carries first and second heating elements on its first and second sides adjacent the cutting edge. The heating elements serves to heat-seal the cut bottom and top edges of the bag including its gussets and the plastic strip material on the first and second sides of the blade. Means are provided for reciprocating the blade between the first and second positions to effect cutting of the tubing at the pre-selected points.

Means are provided for cutting a U-shaped cut-out commencing at the sealed top edge of the bag blank and extending downwardly toward the bottom edge of the blank. When the plastic strip material is located above the gusset and the plastic strip material is then compressed against the tubing and when the blade is brought down against the tubing to cut it transversely, the heating elements on the first and second sides of the blade heat seal the cut bottom and top edges of the bag and the plastic strip material on the first and second sides of the blade, the plastic strip material will be heat sealed into the top and bottom edges of the bag and the strip material will be adhered above the gusset, a U-shaped cut-out is then cut in the bag blank commencing at the sealed top edge and extending downwardly toward the bottom edge, thus yielding an open mouth and a pair of bag handles.

DESCRIPTION OF THE DRAWINGS

FIG. 1 is a perspective view of an open topped bag having an advertising or coupon strip heat sealed to the lower seam of the bag with the removably attached coupons disposed within a gusset along one side of the bag;

FIG. 1A is a cross-sectional view taken along the line 1A-1A of FIG. 1;

FIG. 3 is a perspective view of an open topped bag having an advertising or coupon strip with removably attached coupons adhered within a gusset along one side of the bag;

Figure 2:
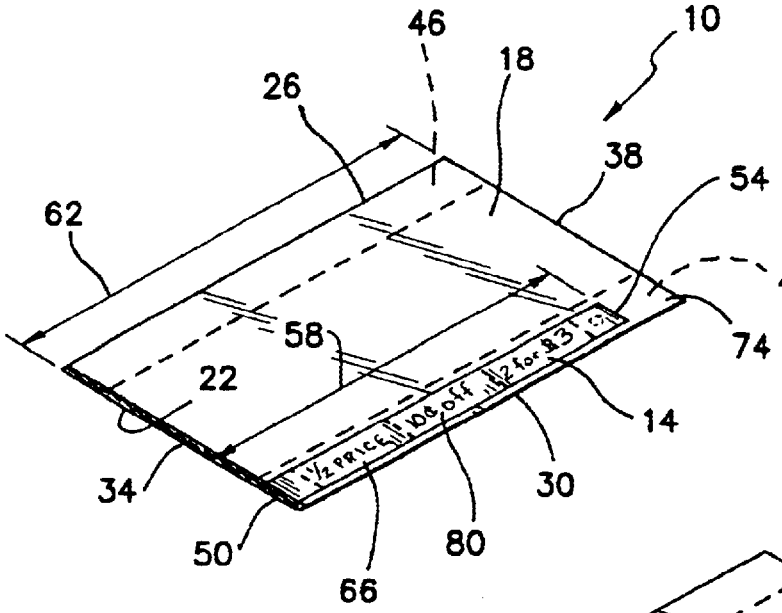
FIG. 2 is a perspective view of an open topped bag having an advertising or coupon strip, illustrating advertising on the coupons, heat sealed to the lower seam of the bag with the removably attached coupons disposed on top of a gusset along one side of the bag.

DETAILED OF THE PREFERRED EMBODIMENT (1) A plastic shopping bag 10 with promotional strip ad 14, as illustrated in FIG. 1 and 1A may be formed from the following components. A pair of registering front 18 and back 22 walls is provided. The walls 18, 22 are secured together along their side 26, 30 and bottom 34 edges and open across at least a portion of their top 38 edges. The walls 18, 22, when pulled apart from each other, defining a space 42 into which articles may be placed. At least one of the secured together side edges 26, 30 is gusseted.

A plastic strip 14 is located within the gusset 46. The strip 14 has a first end 50 and a second end 54 and is of a length 58 not greater than a length 62 of the gusseted side edge 26, 30. The first end 50 of the strip 14 is heat sealed to the bottom edges 34 of the bag walls 18, 22 and the second end 54 of the strip 14 is adhered in the vicinity of the top edges 38 of the bag walls 18, 22. A portion 66 of the strip 14 between its first 50 and second 54 ends is removably attached to a remainder 70 of the strip 14.

(2) In a variant of the invention, as illustrated in FIG. 1, the portion 66 of the strip 14 between its first 50 and second 54 ends is removably attached to the remainder 70 of the strip 14 with at least two perforation lines 72, 76.

(3) In another variation, as illustrated in FIG. 1, promotional material 80 is printed upon at least an upper surface 84 or a lower surface 88 of the portion 66 of the strip 14 between its first 50 and second 54 ends that is removably attached to the remainder 70 of the strip 14.

Figure 2A:
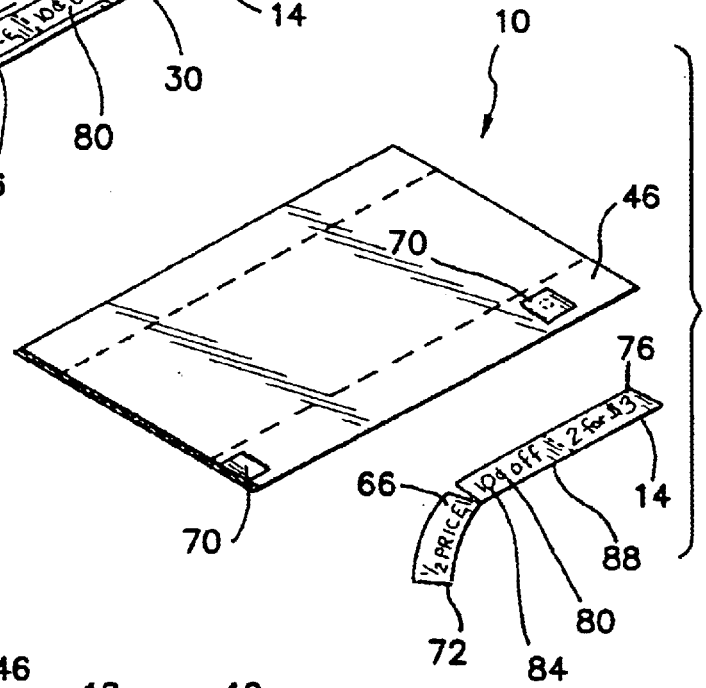
FIG. 2A is a perspective view of the FIG. 2 bag illustrating several detached coupons and the strip ends attached to the bag.

(4) In a variant of the invention, as illustrated in FIGS. 2 and 2A, a plastic strip 14 is located along one side 74 of a gusset 46. The strip 14 has a first end 50 and a second end 54 and is of a length 58 not greater than a length 62 of a gusseted side edge 26, 30. The first end 50 of the strip 14 is heat sealed to the bottom edges 34 of the bag walls 18, 22 and the second 54 end of the strip 14 is adhered in the vicinity of the top edges 38 of the bag walls 18, 22. A portion 66 of the strip 14 between its first 50 and second 54 ends is removably attached to a remainder 70 of the strip 14.

(5) In a variant of the invention, as illustrated in FIGS. 2 and 2A, the portion 66 of the strip 14 between its first 50 and second 54 ends is removably attached to the remainder 70 of the strip 14 with at least two perforation lines 72, 76.

(6) In another variation, as illustrated in FIGS. 2 and 2A, promotional material 80 is printed upon at least an upper surface 84 or a lower surface 88 of the portion 66 of the strip 14 between its first 50 and second 54 ends that is removably attached to the remainder 70 of the strip 14.

(7) In a further variant, as illustrated in FIG. 3, a plastic strip 14 is located within a gusset 46. The strip 14 has a first end 50 and a second end 54 and is of a length 58 not greater than a length 62 of a gusseted side edge 26, 30. The first end 50 of the strip 14 is adhered adjacent the bottom edges 34 of the bag walls 18, 22 and the second end 54 of the strip 14 is adhered in the vicinity of the top edges 38 of the bag walls 18, 22. A portion 66 of the strip 14 between its first 50 and second 54 ends is removably attached to a remainder 70 of the strip 14.

(8) In a variant of the invention, as illustrated in FIG. 3, the portion 66 of the strip 14 between its first 50 and second 54 ends is removably attached to the remainder 70 of the strip 14 with at least two perforation lines 72, 76.

(9) In another variation, as illustrated in FIG. 3, promotional material 80 is printed upon at least an upper surface 84 or a lower surface 88 of the portion 66 of the strip 14 between its first 50 and second 54 ends that is removably attached to the remainder 70 of the strip 14.

Figure 4:
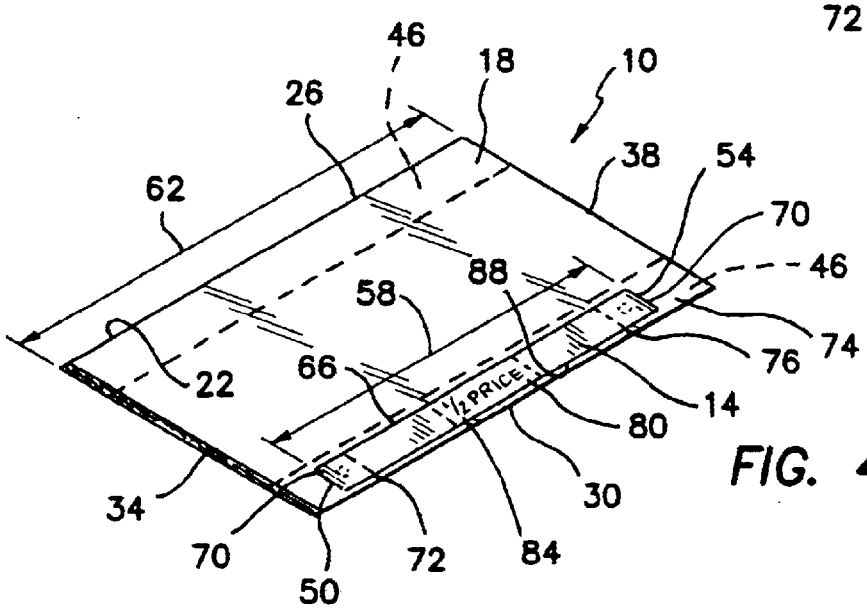
FIG. 4 is a perspective view of an open topped bag having an advertising or coupon strip with removably attached coupons adhered to and disposed on top of a gusset along one side of the bag.

(10) In still a further variant, as illustrated in FIG. 4, a plastic strip 14 is located along one side 74 of a gusset 46. The strip 14 has a first end 50 and a second end 54 and is of a length 58 not greater than a length 62 of a gusseted side edge 26, 30. The first end 50 of the strip 14 is adhered adjacent the bottom edges 34 of the bag walls 18, 22 and the second end 54 of the strip 14 is adhered in the vicinity of the top edges 38 of the bag walls 18, 22. A portion 66 of the strip 14 between its first 50 and second 54 ends is removably attached to a remainder 70 of the strip 14.

(11) In a variant of the invention, as illustrated in FIG. 4, the portion 66 of the strip 14 between its first 50 and second 54 ends is removably attached to the remainder 70 of the strip 14 with at least two perforation lines 72, 76.

(12) In another variation, as illustrated in FIG. 4, promotional material 80 is printed upon at least an upper surface 84 or a lower surface 88 of the portion 66 of the strip 14 between its first 50 and second 54 ends that is removably attached to the remainder 70 of the strip 14.

Figure 5:
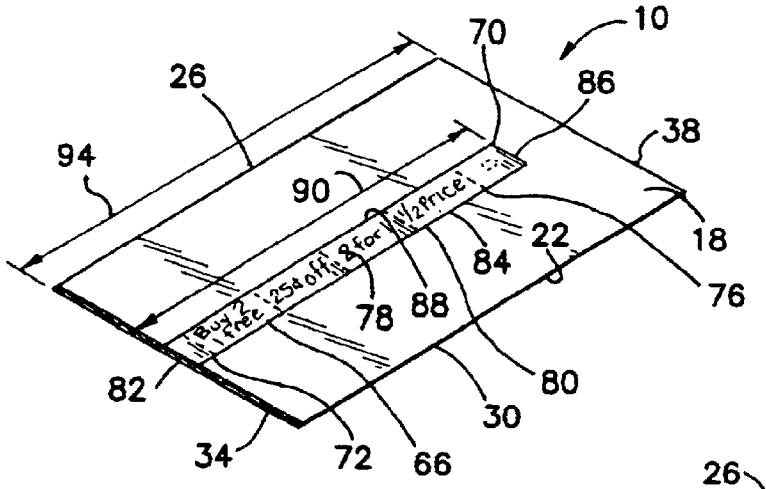
FIG. 5 is a perspective view of an open topped bag having an advertising or coupon strip, illustrating advertising on the coupons, with the removably attached coupons heat sealed to the lower seam of the bag and disposed on either of the front and back surfaces of the bag.

(13) In yet a further variant of the invention, as illustrated in FIG. 5, a plastic strip 78 is located upon at least one of the front 18 and back 22 walls between the side edges 26, 30. The strip 78 has a first end 82 and a second end 86 and is of a length 90 not greater than the length 94 of the walls 18, 22. The first end 82 of the strip 78 is heat sealed to the bottom edges 34 of the bag walls 18, 22 and the second end 86 of the strip 78 is adhered in the vicinity of the top edges 38 of the bag walls 18, 22. A portion 66,of the strip 14 between its first 50 and second 54 ends is removably attached to a remainder 70 of the strip 14.

(14) In a variant of the invention, as illustrated in FIG. 5, the portion 66 of the strip 14 between its first 50 and second 54 ends is removably attached to the remainder 70 of the strip 14 with at least two perforation lines 72, 76.

(15) In another variation, as illustrated in FIG. 5, promotional material 80 is printed upon at least an upper surface 84 or a lower surface 88 of the portion 66 of the strip 14 between its first 50 and second 54 ends that is removably attached to the remainder 70 of the strip 14.

Figure 6:
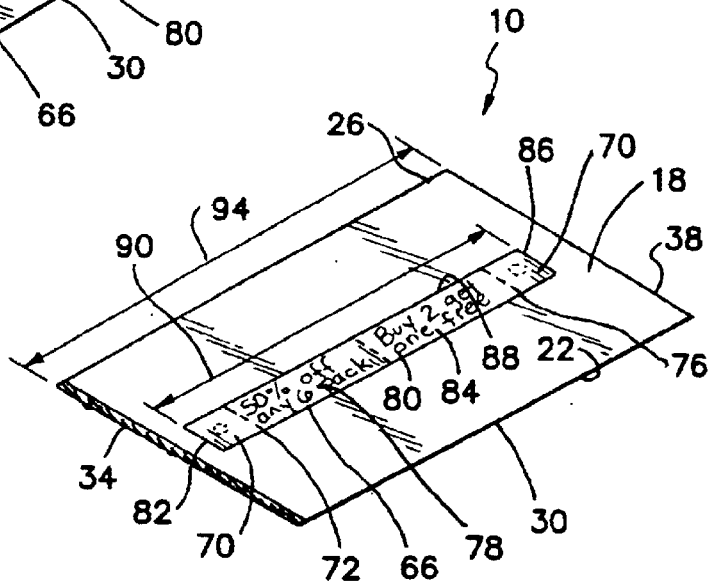
FIG. 6 is a perspective view of an open topped bag having an advertising or coupon strip, illustrating advertising on the coupons, with the removably attached coupons adhered to and disposed on either of the front and back surfaces of the bag.
Figure 6A:
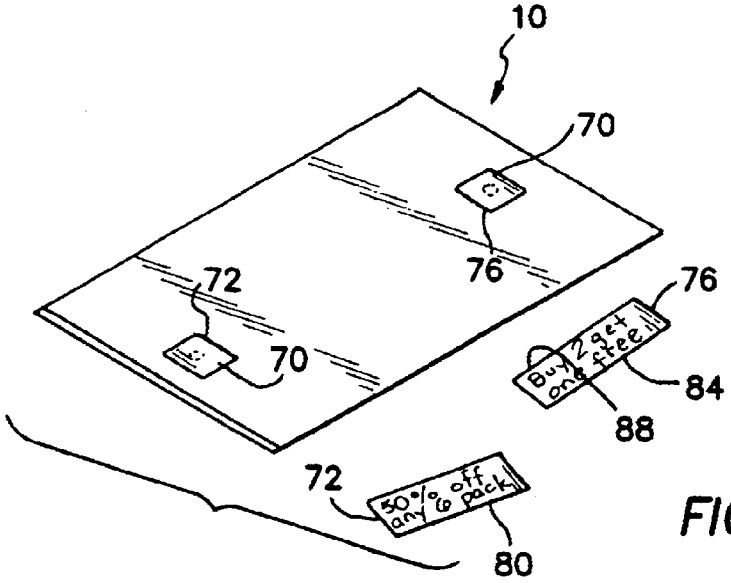
FIG. 6A is a perspective view of the FIG. 6 bag illustrating several detached coupons and the strip ends attached to the bag.

(16) In another variant, as illustrated in FIGS. 6 and 6A, a plastic strip 78 is located upon at least one of front 18 and back 22 walls between the side edges 26, 30. The strip 78 has a first end 82 and a second end 86 and is of a length 90 not greater than the length 94 of the walls 18, 22. The first end 82 of the strip 78 is adhered adjacent the bottom edges 34 of the bag walls 18, 22 and the second end 86 of the strip 78 is adhered in the vicinity of the top edges 38 of the bag walls 18, 22. A portion 66 of the strip 14 between its first 82 and second 86 ends is removably attached to a remainder 70 of the strip 14.

(17) In a variant of the invention, as illustrated in FIGS. 6 and 6A, the portion 66 of the strip 14 between its first 82 and second 86 ends is removably attached to the remainder 70 of the strip 14 with at least two perforation lines 72, 76.

(18) In another variation, as illustrated in FIGS. 6 and 6A, promotional material 80 is printed upon at least an upper surface 84 or a lower surface 88 of the portion 66 of the strip 14 between its first 82 and second 86 ends that is removably attached to the remainder 70 of the strip 14.

Figure 7:
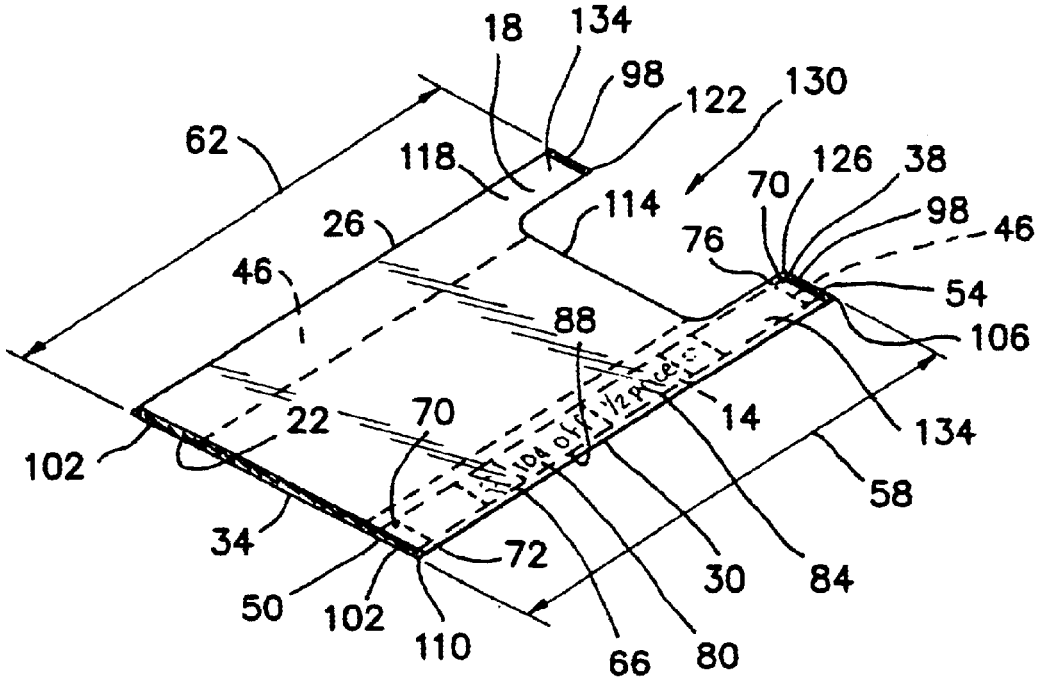
FIG. 7 is a perspective view of a T-shirt style bag having an advertising or coupon strip with removably attached coupons heat sealed to the upper and lower seams of the bag and adhered to and disposed within a gusset along one side of the bag.

(19) In still another variant, as illustrated in FIG. 7, the secured together first 26 and second 30 side edges are folded inwardly from the front 18 and back 22 walls to form a pair of gussets 46. The gussets 46 have top 98 and bottom 102 edges. The top edges 38, 98 of the front wall 18, the back wall 22, and the gussets 46 terminate in an upper seam 106. The bottom edges 34, 102 of the front wall 18, the back wall 22, and the gussets 46 terminate in a lower seam 110. The lower seam 110 is perpendicular to the side edges 26, 30 of the front 18 and back 22 walls.

A U-shaped cut-out 114 is located in an upper portion 118 of the bag 10. The cut-out 114 commences at a first point 122 along the upper seam 106 spaced inwardly from the first side edge 26. The cut-out 114 extends to a second point 126 along the upper seam 106 spaced inwardly from the second side edge 30. The cut-out 114 extends downwardly toward the lower seam 110, forming an open mouth 130 and a pair of bag handles 134.

A plastic strip 14 is located within at least one gusset 46. The strip 14 has a first end 50 and a second end 54 and is of a length 58 not greater than a length 62 of the gusset 46. The first end 50 of the strip 14 is heat sealed to the lower seam 110 and the second end 54 of the strip 14 is heat sealed to the upper seam 106. The strip 14 is adhered to the gusset 46 between the first end 50 and the second end 54 of the strip 14. A portion 66 of the strip 14 between its first 50 and second 54 ends is removably attached to a remainder 70 of the strip 14.

(20) In a variant of the invention, as illustrated in FIG. 7, the portion 66 of the strip 14 between its first 50 and second 54 ends is removably attached to the remainder 70 of the strip 14 with at least two perforation lines 72, 76.

(21) In another variation, as illustrated in FIG. 7, promotional material 80 is printed upon at least an upper surface 84 or a lower surface 88 of the portion 66 of the strip 14 between its first 50 and second 54 ends that is removably attached to the remainder 70 of the strip 14.

Figure 8:
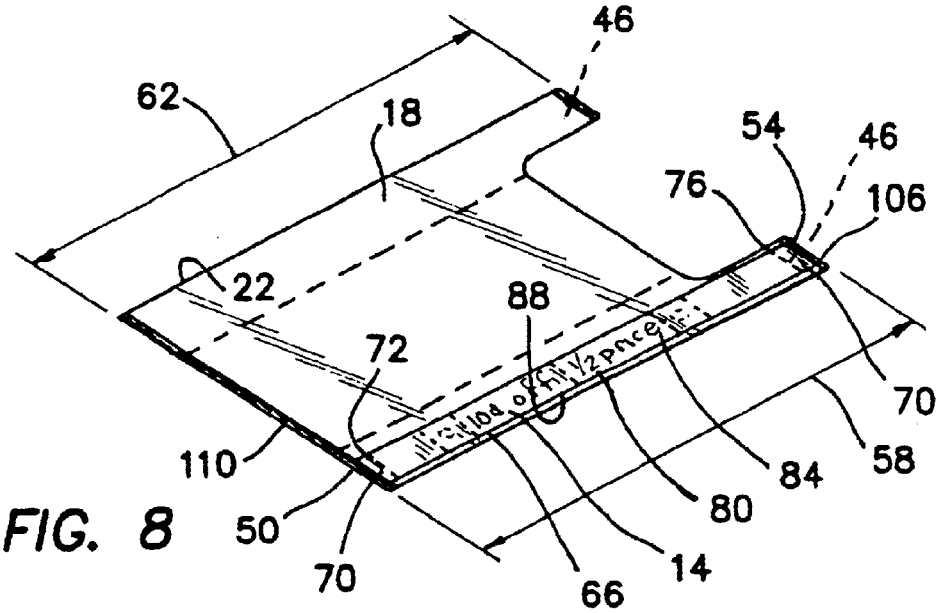
FIG. 8 is a perspective view of a T-shirt style bag having an advertising or coupon strip with removably attached coupons heat sealed to the upper and lower seams of the bag and adhered to and disposed on top of a gusset along one side of the bag.

(22) In a final variant, as illustrated in FIG. 8, a plastic strip 14 is located upon at least one of the front 18 and back 22 walls above at least one gusset 46. The strip 14 has a first end 50 and a second end 54 and is of a length 58 not greater than the length 62 of the gusset 46. The first end 50 of the strip 14 is heat sealed to the lower seam 110 and the second end 54 of the strip 14 is heat sealed to the upper seam 106. The strip 14 is adhered to one of the front 18 and back 22 walls above at least one gusset 46 between the first end 50 and the second end 54 of the strip 14. A portion 66 of the strip 14 between its first 50 and second 54 ends is removably attached to a remainder 70 of the strip 14.

(23) In a variant of the invention, as illustrated in FIG. 8, the portion 66 of the strip 14 between its first 50 and second 54 ends is removably attached to the remainder 70 of the strip 14 with at least two perforation lines 72, 76.

(24) In another variation, as illustrated in FIG. 8, promotional material 80 is printed upon at least an upper surface 84 or a lower surface 88 of the portion 66 of the strip 14 between its first 50 and second 54 ends that is removably attached to the remainder 70 of the strip 14.

Figure 9:
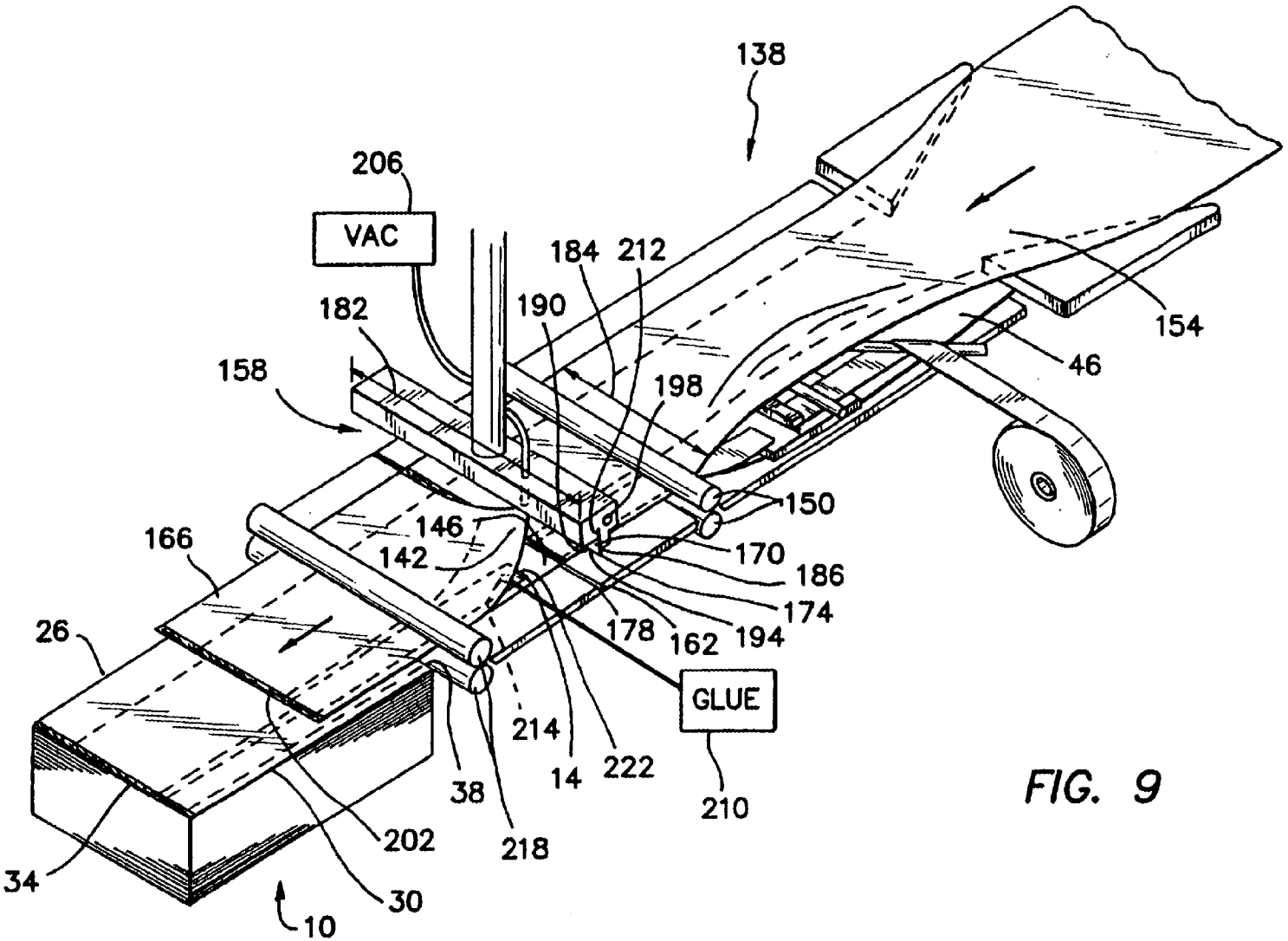
FIG. 9 is a perspective view of the bag making apparatus for forming the FIG. 1 bags.

An apparatus 138 for fabricating plastic shopping bags 10, as illustrated in FIG. 9, is provided. Each of the bags 10 has closed side 26, 30 and bottom 34 edges. At least one side edge 26, 30 is gusseted. The bag 10 has an open top edge 38. The gusseted side edge 26, 30 includes an upper wall portion 142 and a lower wall portion 146 in abutment with each other. A plastic strip 14 is located between the upper 142 and lower 146 wall portions of the gusseted side edge 26, 30.

The apparatus 138 includes means 150 for moving extruded flattened and gusseted plastic tubing 154 that has a plastic strip 14 located in the gusset 46, in a horizontal plane into a cutting station 158. The station 158 has a horizontal planar blade receiving area 162 over which the flattened tubing 154 is moved to be cut into a series of rectangular blanks 166. A blade 170 is provided for cutting the tubing 154 transversely at the cutting station 158.

The tubing 154 is cut at pre-selected points along the tubing length to produce the series of blanks 166 of a predetermined length. The blade 170 is reciprocatable between a first upper poised position 174, and a second lower cutting position 178 on the planar blade receiving area 162. The blade 170 is of a length 182 at least as great as the width 184 of the gusseted tubing 154. The blade 170 has a first side 186 and a second side 190. The blade 170 further has a cutting edge 194 and carries a heating element 198 on its first side 186 adjacent the cutting edge 194. The heating element 198 serves to heat seal the cut edge 202 of the tubing 154 including its gusset 46 and enclosed plastic strip 14 portion on the first side 186 of the blade 170.

A vacuum element 206 is located on the blade's 170 second side 190 also adjacent the cutting edge 194 and above the upper wall portion 142 of the gusseted side edge 26, 30. The vacuum element 206, when the blade 170 is lowered to its second position 178, extends to at least one gusset 46 of the tubing 154. The vacuum element 206 is located adjacent the portion of the blade edge 194 which, upon the blade 170 being lowered to its second position 178, cuts through the gusset 46.

An adhesive injector 210 is located adjacent the side edge 212 of the blade 170 and proximate to the portion of the blade edge 194 carrying the vacuum element 206. Means (not shown) are provided for reciprocating the blade 170 between the first 174 and second 178 positions to effect cutting of the tubing 154 at the pre-selected points. Means (not shown) are provided for producing a vacuum in the vacuum element 206 when the blade 170 is moved to its second position 178 to cut the tubing 154 and abutting plastic strip 14, at which instant the adjacent area of the upper wall portion 142 of the gusset 46 is momentarily raised from its abutment with the plastic strip 14.

Means (not shown) are provided for activating the adhesive injector 210 momentarily to discharge a pre-selected quantity of adhesive 214 between the raised upper wall portion 142 of the gusset 46 and the plastic strip 14 when the vacuum element 206 momentarily lifts the upper wall portion 142. Means 218 located adjacent the first side 186 of the blade 170 and in line with the raised portion of the gusset 46 are provided, to compress the raised area of the gusset 46 back to the plane of the remaining portion of the cut blank 166 and against the plastic strip 14.

When the blade 170 is brought down against the tubing 154 to cut it transversely, the heating element 198 on the first side 186 of the blade 170 heat-seals the cut edge 202 of the tubing 154 on the first side 186 of the blade 170, and the vacuum element 206 on the second side 190 of the blade 170 momentarily lifts an area of the upper wall portion 142 of the gusset 46 adjacent (the edge of) the second side 190 of the blade 170. The adhesive injector 210 then discharges a pre-selected quantity of adhesive 214 between the raised area of the upper portion of the gusset 46 and the cut end 222 of the plastic strip 14, following which, upon the raising of the blade 170 to its first position 174, the adhesive receiving upper edge of the gusset 46 is pressed back down against the cut end 222 of the plastic strip 14 to the plane of the remainder of the cut blank 166.

Figure 10:
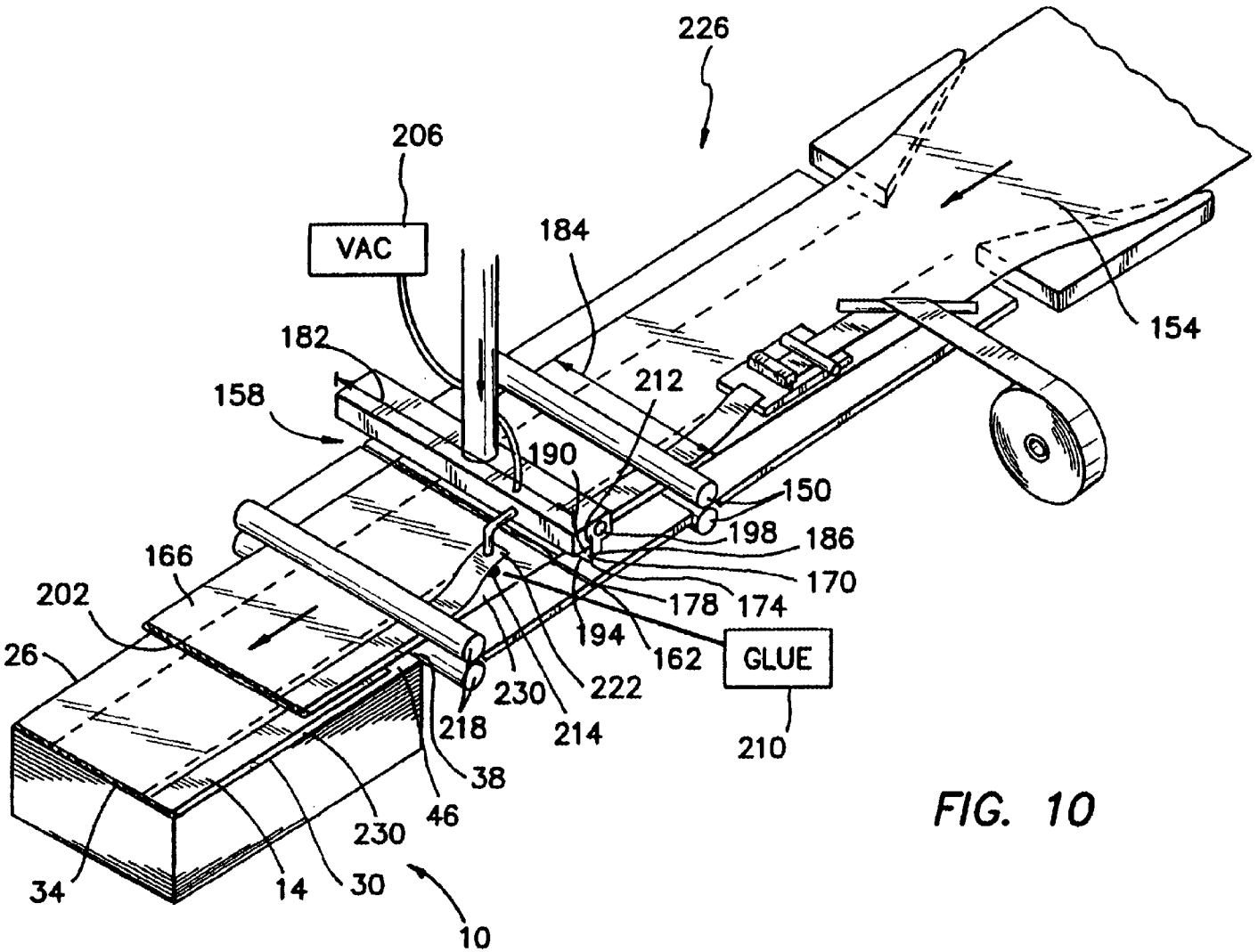
FIG. 10 is a perspective view of the bag making apparatus for forming the FIG. 2 bags.

In a variant of the apparatus 226, as illustrated in FIG. 10, designed for fabricating plastic bags 10 each having an open top edge 38, at least one gusseted side edge 26, 30 and a plastic strip 14 located along one side 230 of the gusseted side edge 26, 30, the apparatus 226 includes means 150 for moving flattened plastic tubing 154 in a horizontal plane into a cutting station 158. The station 158 has a horizontal planar blade receiving area 162 over which the flattened tubing 154 is moved to be cut into a series of rectangular blanks 166. The tubing 154 is gusseted along at least one side edge 26, 30 and has a plastic strip 14 located along one side 230 of the gusset 46 of the side edge 26, 30.

A blade 170 is provided for cutting the tubing 154 transversely at pre-selected points along its length to produce the series of blanks 166. The blade 170 is reciprocatable between a first upper poised position 174, and a second lower cutting position 178 on the planar blade receiving area 162. The blade 170 is of a length 182 at least as great as the width 184 of the gusseted tubing 154. The blade 170 has a first side 186 and a second side 190. The blade 170 further has a cutting edge 194 and carries a heating element 198 on its first side 186 adjacent the cutting edge 194 and a vacuum element 206 on its second side 190 adjacent the cutting edge 194.

The heating element 198 serves to heat seal the cut edge 202 of the tubing 154 including its gusset 46 and the plastic strip 14 located along one side 230 of the gusseted side edge 26, 30 on the first side 186 of the blade 170. The vacuum element 206, when the blade 170 is lowered to its second position 178, extends to at least one gusset 46 of the tubing 154. The vacuum element 206 is located adjacent the portion of the blade edge 194 which, upon the blade 170 being lowered to its second position 178, cuts through the gusset 46 and abutting plastic strip 14.

An adhesive injector 210 is located adjacent the side edge 212 of the blade 170 and proximate to the portion of the blade edge 194 carrying the vacuum element 206. Means (not shown) are provided for reciprocating the blade 170 between the first 174 and second 178 positions to effect cutting of the tubing 154 at the pre-selected points. Means (not shown) are provided for producing a vacuum in the vacuum element 206 when the blade 170 is moved to its second position 178 to cut the tubing 154 and abutting plastic strip 14, at which instant the cut end 222 of the plastic strip 14 is momentarily raised from the side 230 (edge) of the gusset 46.

Means (not shown) are provided for activating the adhesive injector 210 momentarily to discharge a pre-selected quantity of adhesive 214 between the raised plastic strip 14 and the side 230 of the gusset 46 when the vacuum element 206 raises the strip 14. Means 218 are provided adjacent the first side 186 of the blade 170 and in line with the raised portion of the strip 14, to compress the raised upper cut end 222 of the strip 14 to the plane of the cut blank 166.

When the blade 170 is brought down against the tubing 154 to cut it transversely, the heating element 198 on the first side 186 of the blade 170 heat-seals the cut edge 202 of the tubing 154 and the plastic strip 14 on the first side 186 of the blade 170. Next the vacuum element 206 on the second side 190 of the blade 170 momentarily raises the cut end 222 of the plastic strip 14 adjacent (the edge of) the second side 190 of the blade 170. At this instant, the adhesive injector 210 discharges a pre-selected quantity of adhesive 214 between the raised cut end 222 of the strip 14 and the side 230 of the gusset 46, following which, upon the lifting of the blade 170 to its first position 174, the adhesive receiving cut end 222 of the plastic strip 14 is pressed back down to the plane of the cut blank 166.

Figure 11:
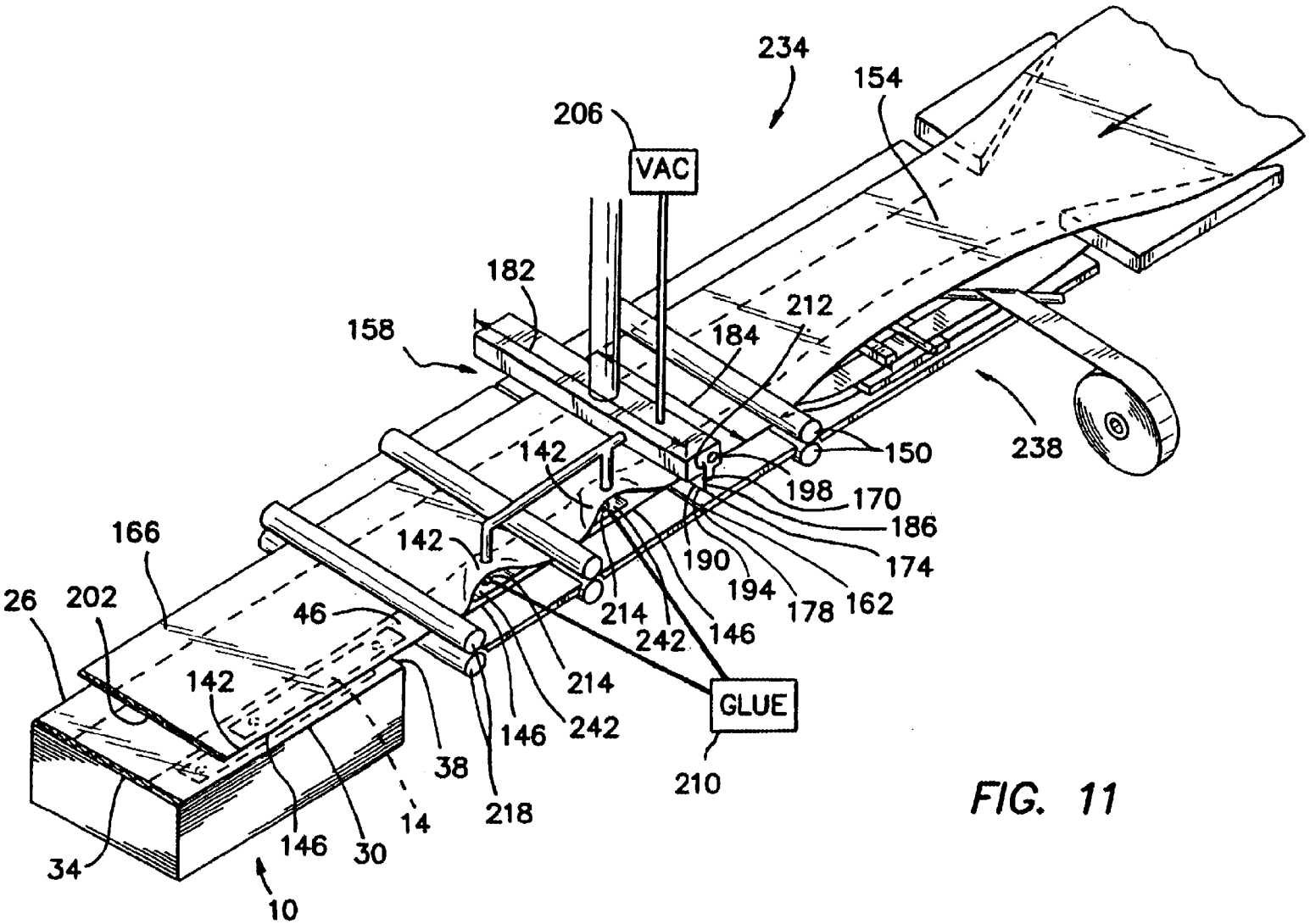
FIG. 11 is a perspective view of the bag making apparatus for forming the FIG. 3 bags.

Another variant of the apparatus 234, as illustrated in FIG. 11, is designed for fabricating plastic shopping bags 10. Each of the bags 10 has closed side 26, 30 and bottom 34 edges, at least one gusseted side edge 26, 30, and an open top edge 38. The gusseted side edge 26, 30 includes an upper wall portion 142 and a lower wall portion 146 in abutment with each other, and a plastic strip 14 located between the upper 142 and lower 146 wall portions of the gusseted side edge 26, 30.

The apparatus 234 includes means 150 for moving extruded flattened and gusseted plastic tubing 154 in a horizontal plane into a cutting station 158. The station 158 has a horizontal planar blade receiving area 162 over which the flattened tubing 154 is moved to be cut into a series of rectangular blanks 166. A blade 170 is provided for cutting the tubing 154 transversely at the cutting station 158 at pre-selected points along the tubing length to produce the series of blanks 166 of a predetermined length. The blade 170 is reciprocatable between a first upper poised position 174, and a second lower cutting position 178 on the planar blade receiving area 162. The blade 170 is of a length 182 at least as great as the width 184 of the gusseted tubing 154. The blade 170 has a first side 186 and a second side 190. The blade 170 further has a cutting edge 194 and carries a heating element 198 on its first side 186 adjacent the cutting edge 194.

The heating element 198 serves to heat seal the cut edge 202 of the tubing 154 including its gusset 46 on the first side 186 of the blade 170. A vacuum element 206 is located on its second side 190 also adjacent the cutting edge 194 and above the upper wall portion 142 of the gusseted side edge 26, 30. The vacuum element 206, when the blade 170 is lowered to its second position 178, extends to the gusset 46 of the tubing 154. The vacuum element 206 is located adjacent the portion of the blade edge 194 which, upon the blade 170 being lowered to its second position 178, cuts through the tubing 154. An adhesive injector 210 is located adjacent the side edge 212 of the blade 170 and proximate to the portion of the blade edge 194 carrying the vacuum element 206.

Means (not shown) are provided for reciprocating the blade 170 between the first 174 and second 178 positions to effect cutting of the tubing 154 at the pre-selected points. Means (not shown) are provided for producing a vacuum in the vacuum element 206 when the blade 170 is moved to its second position 178 to cut the tubing 154 at which instant the adjacent area of the upper wall portion 142 of the gusset 46 is momentarily raised from its abutment with the lower wall portion 146 of the gusset 46.

Means 238 are provided for inserting a plastic strip 14 of predetermined length into the gusset 46. Means (not shown) are provided for activating the adhesive injector 210 momentarily to discharge a pre-selected quantity of adhesive 214 in at least two locations 242 between the raised upper wall portion 142 of the gusset 46 and the plastic strip 14 when the vacuum element 206 momentarily lifts the upper wall portion 142. Means 218 are provided adjacent the first side 186 of the blade 170 and in line with the raised upper portion 142 of the gusset 46, to compress the raised area 142 of the gusset 46 back to the plane of the remaining portion of the cut blank 166 and against the plastic strip 14.

When the blade 170 is brought down against the tubing 154 to cut it transversely, the heating element 198 on the first side 186 of the blade 170 heat-seals the cut edge 202 of the tubing 154 on the first side 186 of the blade 170, and the vacuum element 206 on the second side 190 of the blade 170 momentarily lifts an area of the upper portion 142 of the gusset 46 adjacent the (edge of the) second side 190 of the blade 170, a plastic strip 14 of predetermined length is inserted into the gusset 46 and the adhesive injector 210 discharges a pre-selected quantity of adhesive 214 between the raised area of the portion 142 of the gusset 46 and at least two locations 242 on the plastic strip 14. Next, upon the raising of the blade 170 to its first position 174, the adhesive receiving upper edge of the gusset 46 is pressed back down against the plastic strip 14 to the plane of the remainder of the cut blank 166.

Figure 12:
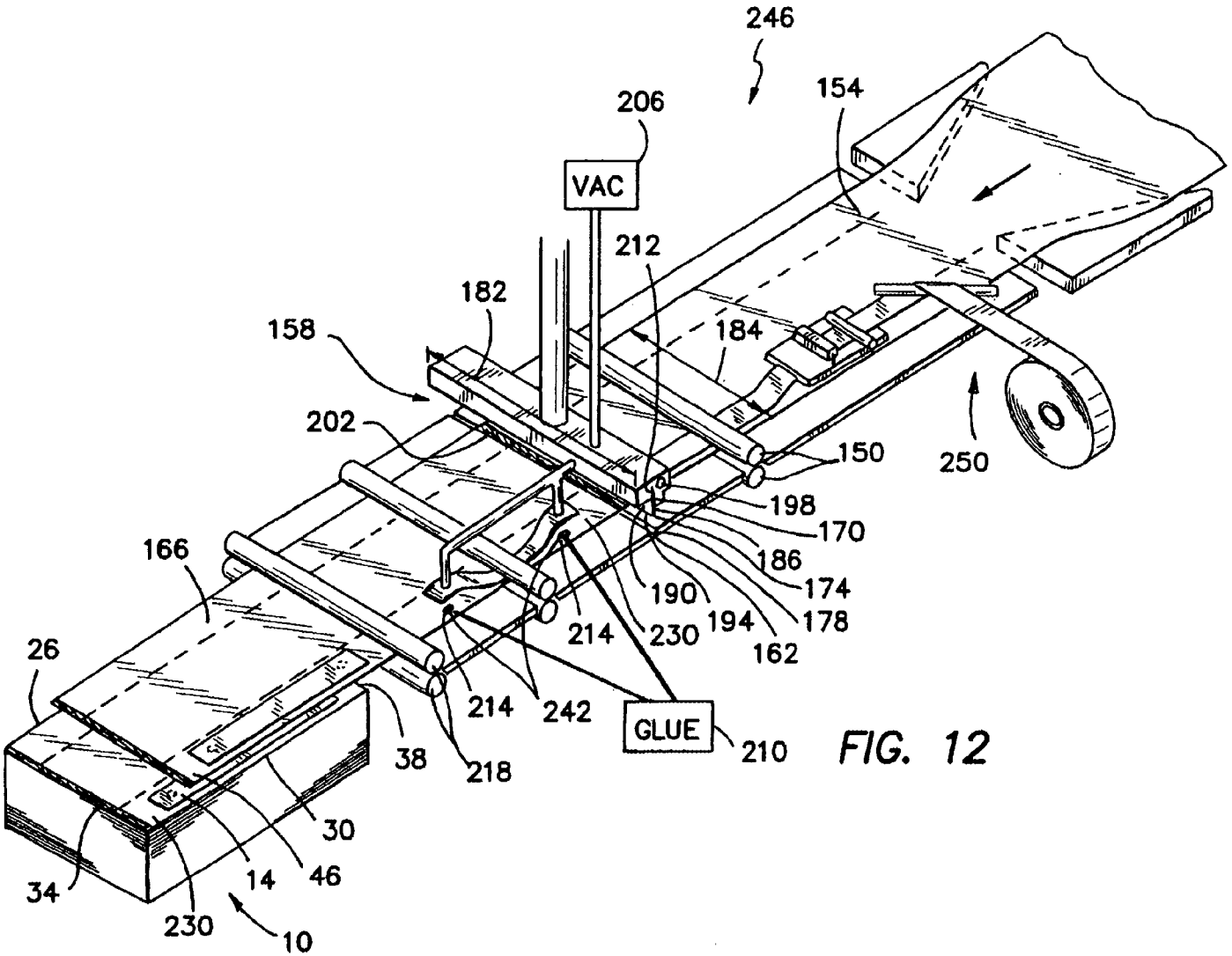
FIG. 12 is a perspective view of the bag making apparatus for forming the FIG. 4 bags.

Yet another variant of the apparatus 246, as illustrated in FIG. 12, is designed for fabricating plastic bags 10 each having an open top edge 38, at least one gusseted side edge 26, 30 and a plastic strip 14 located along one side 230 of the gusseted side edge 26, 30. The apparatus 246 includes means 150 for moving flattened plastic tubing 154 in a horizontal plane into a cutting station 158. The station 158 has a horizontal planar blade receiving area 162 over which the flattened tubing 154 is moved to be cut into a series of rectangular blanks 166. The tubing 154 is gusseted along at least one side edge 26, 30.

A blade 170 is provided for cutting the tubing 154 transversely at pre-selected points along its length to produce the series of blanks 166. The blade 170 is reciprocatable between a first upper poised position 174, and a second lower cutting position 178 on the planar blade receiving area 162. The blade 170 is of a length 182 at least as great as the width 184 of the gusseted tubing 154. The blade 170 has a first side 186 and a second side 190. The blade 170 further has a cutting edge 194 and carries a heating 198 element on its first side 186 adjacent the cutting edge 194. The heating element 198 serves to heat seal the cut edge 202 of the tubing 154 including its gusset 46 on the first side 186 of the blade 170.

An adhesive injector 210 is located adjacent the side edge 212 of the blade 170. Means (not shown) are provided for reciprocating the blade 170 between the first 174 and second 178 positions to effect cutting of the tubing 154 at the pre-selected points. Means (not shown) are provided for activating the adhesive injector 210 momentarily to discharge a pre-selected quantity of adhesive 214 at at least two locations 242 along one side 230 of the gusseted side edge 26, 30 of the bag blank 166. Means 250 are provided for locating a plastic strip 14 of a predetermined length along one side 230 of the gusseted side edge 26, 30 of the bag blank 166 over the discharged adhesive 214. Means 218 are provided adjacent the first side 186 of the blade 170 and in line with the plastic strip 14, to compress the strip 14 to the gusseted side edge 26, 30 of the bag blank 166.

When the blade 170 is brought down against the tubing 154 to cut it transversely, the heating 198 element on the first side 186 of the blade 170 heat-seals the cut edge 202 of the tubing 154 on the first side 186 of the blade 170. Next, the adhesive injector 210 discharges a pre-selected quantity of adhesive 214 at at least two locations 242 along one side 230 of the gusseted side edge 26, 30 of the bag blank 166. Next, a plastic strip 14 of a predetermined length is located along one side 230 of the gusseted side edge 26, 30 of the bag blank 166 over the discharged adhesive 214, and the plastic strip 14 is compressed to the gusseted side edge 26, 30 of the bag blank 166.

Figure 13:
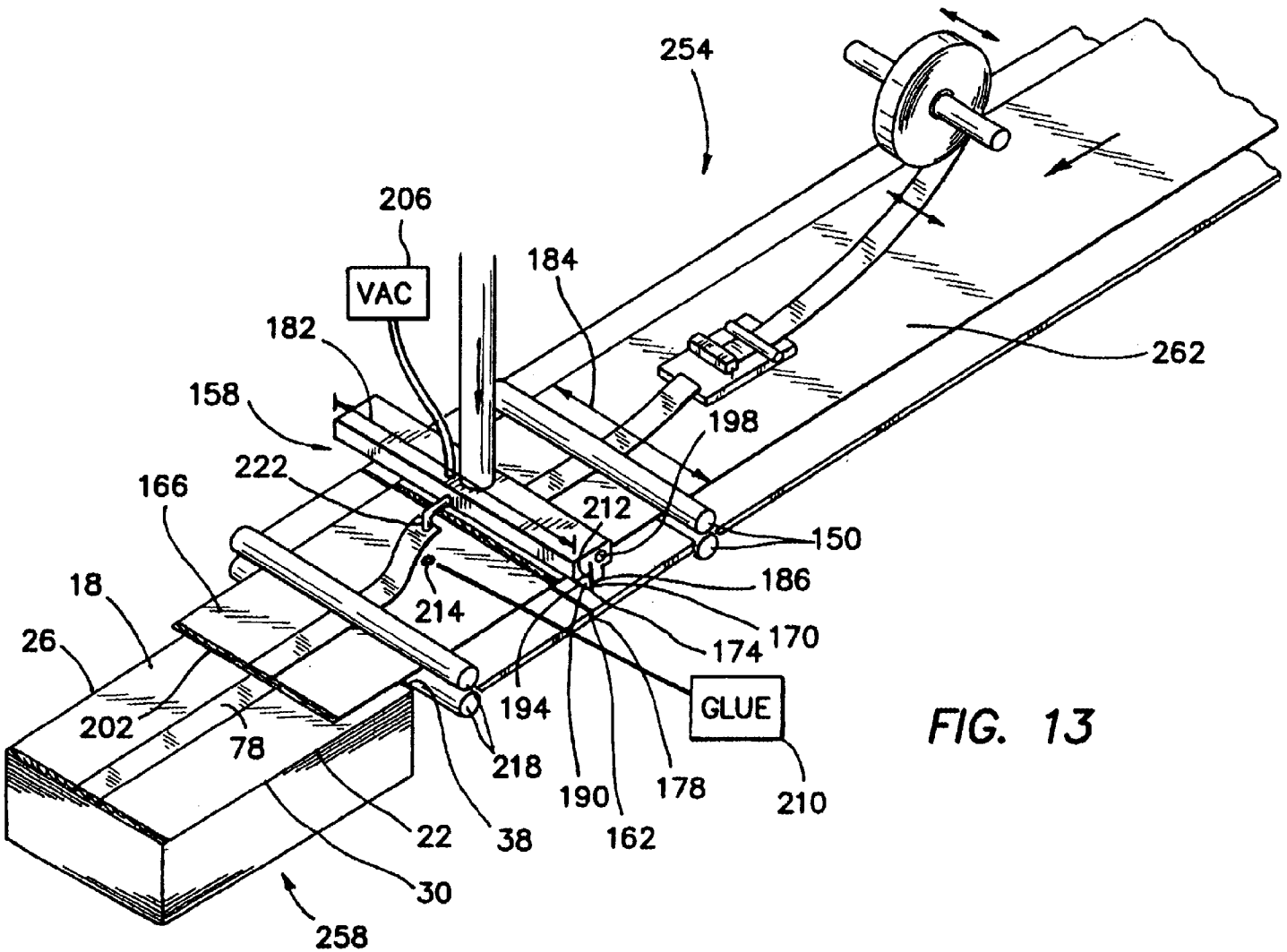
FIG. 13 is a perspective view of the bag making apparatus for forming the FIG. 5 bags.

Yet another variant of the apparatus 254, as illustrated in FIG. 13, is designed for fabricating plastic bags 258 each having an open top edge 38 and a plastic strip 78 disposed upon at least one of the front 18 and back 22 walls between the side edges 26, 30. The apparatus 254 includes means 150 for moving flattened plastic tubing 262 in a horizontal plane into a cutting station 158. The station 158 has a horizontal planar blade receiving area 162 over which the flattened tubing 262 is moved to be cut into a series of rectangular blanks 166. The tubing 262 has a plastic strip 78 disposed upon at least one of the front 18 and back 22 walls between the side edges 26, 30.

A blade 170 is provided for cutting the tubing 262 transversely at pre-selected points along its length to produce the series of blanks 166. The blade 170 is reciprocatable between a first upper poised position 174, and a second lower cutting position 178 on the planar blade receiving area 162. The blade 170 is of a length 182 at least as great as the width 184 of the tubing 262. The blade 170 has a first side 186 and a second side 190. The blade 170 further has a cutting edge 194 and carries a heating element 198 on its first side 186 adjacent the cutting edge 194 and a vacuum element 206 on its second side 190 adjacent the cutting edge 194. The heating element 198 serves to heat seal the cut edge 202 of the tubing 262 and the plastic strip 78 disposed upon at least one of the front 18 and back 22 walls between the side edges 26, 30 on the first side 186 of the blade 170.

The vacuum element 206, when the blade 170 is lowered to its second position 190, extends to the side edges 26, 30 of the tubing 262. The vacuum element 206 is located adjacent the portion of the blade edge 194 which, upon the blade 170 being lowered to its second position 178, cuts through the tubing 262 and abutting plastic strip 78. An adhesive injector 210 is located adjacent the side edge 212 of the blade 170 and proximate to the portion of the blade edge 194 carrying the vacuum element 206. Means (not shown) are provided for reciprocating the blade 170 between the first 174 and second 178 positions to effect cutting of the tubing 262 at the pre-selected points.

Means (not shown) are provided for producing a vacuum in the vacuum element 206 when the blade 170 is moved to its second position 178 to cut the tubing 262 and abutting plastic strip 78, at which instant the cut end 222 of the plastic strip 78 is momentarily raised from either of the front 18 and back 22 walls. Means (not shown) are provided for activating the adhesive injector 210 momentarily to discharge a pre-selected quantity of adhesive 214 between the raised plastic strip 78 and either of the front 18 and back 22 walls when the vacuum element 206 raises the strip 78. Means 218 are provided adjacent the first side 186 of the blade 170 and in line with the raised portion of the strip 78, to compress the raised upper cut end 222 of the strip 78 to the plane of the cut blank 166.

When the blade 170 is brought down against the tubing 262 to cut it transversely, the heating element 198 on the first side 186 of the blade 170 heat-seals the cut edge 202 of the tubing 262 and the plastic strip 78 on the first side 186 of the blade 170, and the vacuum element 206 on the second side 190 of the blade 170 momentarily raises the cut end 222 of the plastic strip 78 adjacent the (edge of the) second side 190 of the blade 170. At this instant, the adhesive injector 210 discharges a pre-selected quantity of adhesive 214 between the raised cut end 222 of the strip 78 and either of the front 18 and back 22 walls. Next, upon the lifting of the blade 170 to its first position 174, the adhesive receiving cut end 222 of the plastic strip 78 is pressed back down to the plane of the cut blank 166.

Figure 14:
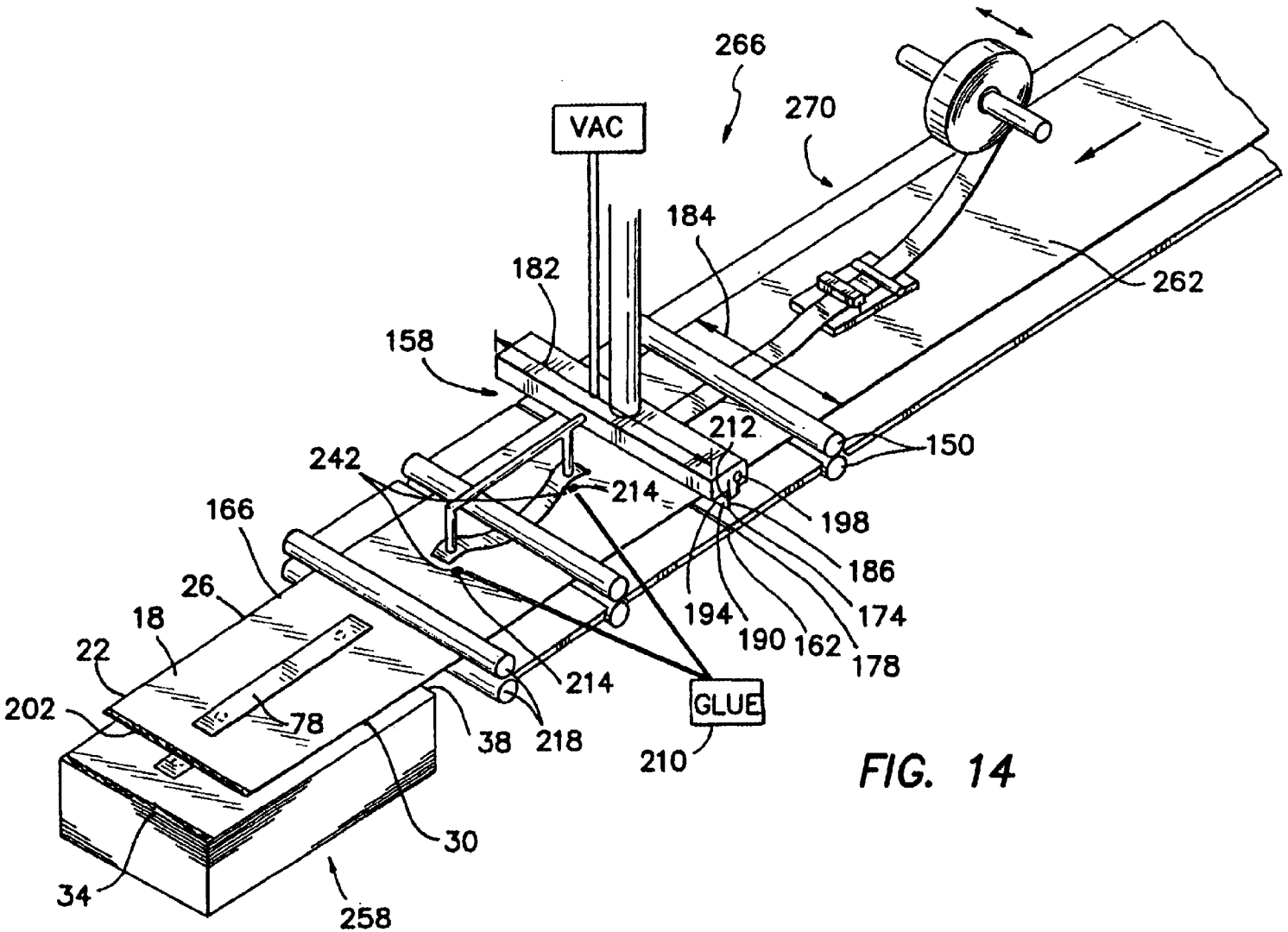
FIG. 14 is a perspective view of the bag making apparatus for forming the FIG. 6 bags.

Still another variant of the apparatus 266, as illustrated in FIG. 14, is designed for fabricating plastic bags 258 each having an open top edge 38 and a plastic strip 78 upon at least one of the front 18 and back 22 walls between the side edges 26, 30. The apparatus 266 includes means 150 for moving flattened plastic tubing 262 in a horizontal plane into a cutting station 158. The station 158 has a horizontal planar blade receiving area 162 over which the flattened tubing 262 is moved to be cut into a series of rectangular blanks 166.

A blade 170 is provided for cutting the tubing 262 transversely at pre-selected points along its length to produce the series of blanks 166. The blade 170 is reciprocatable between a first upper poised position 174, and a second lower cutting position 178 on the planar blade receiving area 162. The blade 170 is of a length 182 at least as great as the width 184 of the tubing 262. The blade 170 has a first side 186 and a second side 190. The blade 170 further has a cutting edge 194 and carries a heating element 198 on its first side 186 adjacent the cutting edge 194.

The heating element 198 serves to heat seal the cut edge 202 of the tubing 262 on the first side 186 of the blade 170. An adhesive injector 210 is located adjacent the side edge 212 of the blade 170. Means (not shown) are provided for reciprocating the blade 170 between the first 174 and second 178 positions to effect cutting of the tubing 262 at the pre-selected points. Means (not shown) are provided for activating the adhesive injector 210 momentarily to discharge a pre-selected quantity of adhesive 214 at at least two locations 242 upon at least one of the front 18 and back 22 walls between the side edges 26, 30 of the bag blank 166.

Means 270 are provided for locating a plastic strip 78 of a predetermined length upon at least one of the front 18 and back 22 walls between the side edges 26, 30 of the bag blank 166 over the discharged adhesive 214. Means 218 are provided adjacent the first side 186 of the blade 170 and in line with the plastic strip 78, to compress the strip 78 to either of the front 18 and back 22 walls of the bag blank 166.

When the blade 170 is brought down against the tubing 262 to cut it transversely, the heating element 198 on the first side 186 of the blade 170 heat-seals the cut edge 202 of the tubing 262 on the first side 186 of the blade 170. Next, the adhesive injector 210 discharges a pre-selected quantity of adhesive 214 at at least two locations 242 upon at least one of the front 18 and back 22 walls between the side edges 26, 30 of the bag blank 166. Next, a plastic strip 78 of a predetermined length is located upon at least one of the front 18 and back 22 walls between the side edges 26, 30 of the bag blank 166 over the discharged adhesive 214. The plastic strip 78 is then compressed to the wall 18, 22 of the bag blank 166.

Figure 15:
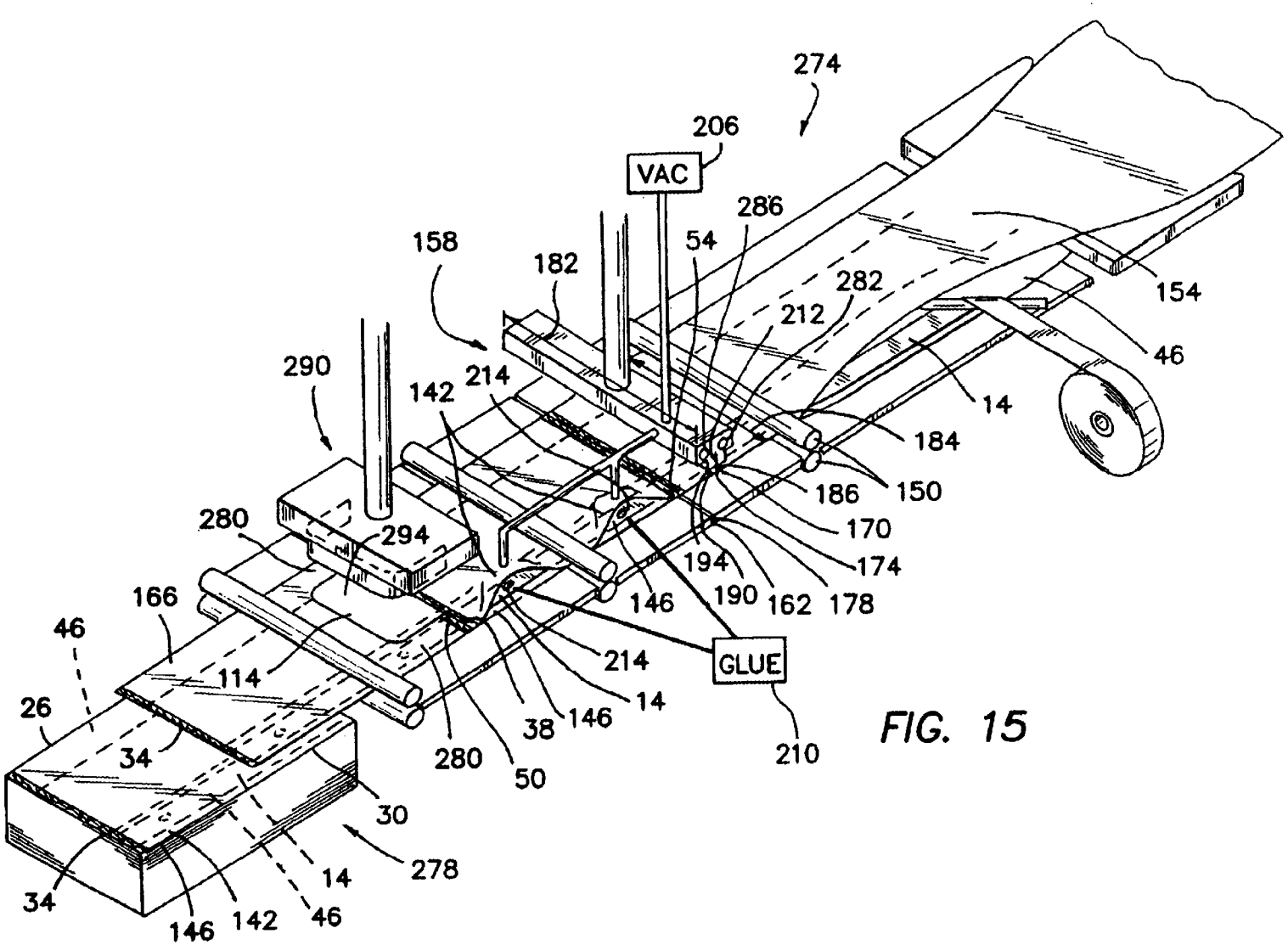
FIG. 15 is a perspective view of the bag making apparatus for forming the FIG. 7 bags.

A further variant of the apparatus 274, as illustrated in FIG. 15, is designed for fabricating plastic bags 278 each having closed side 26, 30 and bottom edges 34, first and second side gussets 46, a partially open top edge 38, and a pair of bag handles 280 terminating at the top edge 38. The gussets 46 are comprised of an upper wall portion 142 and a lower wall portion 146 in abutment with each other. A plastic strip 14 is located between the upper 142 and lower 146 wall portions of at least one gusset 46.

The apparatus 274 includes means 150 for moving extruded flattened and gusseted plastic tubing 154 having a plastic strip 14 disposed in at least one of the gussets 46, in a horizontal plane into a cutting station 158. The station 158 has a horizontal planar blade receiving area 162 over which the flattened tubing 154 is moved to be cut into a series of rectangular blanks 166.

A blade 170 is provided for cutting the tubing 154 transversely at the cutting station 158 at pre-selected points along the tubing length to produce the series of blanks 166 of a predetermined length. The blade 170 is reciprocatable between a first upper poised position 174, and a second lower cutting position 178 on the planar blade receiving area 162. The blade 170 is of a length 182 at least as great as the width 184 of the gusseted tubing 154. The blade 170 has a first side 186 and a second side 190. The blade 170 further has a cutting edge 194 and carries first 282 and second 286 heating elements on its first 186 and second 190 sides adjacent the cutting edge 194. The heating elements 282, 286 serve to heat seal the cut bottom 34 and top edges 38 of the bags 278 including its gussets 46 and enclosed plastic strip 14 (portion) on the first 186 and second 190 sides of the blade 170.

A vacuum element 206 is located on the second side 190 of the blade 170 and spaced from the second heating element 286 and above the upper wall portion 142 of the gusseted side edge 26, 30. The vacuum element 206, when the blade 170 is lowered to its second position 178, extends to at least one gusset 46 of the tubing 154. An adhesive injector 210 is located adjacent the side edge 212 of the blade 170 and proximate to the portion of the blade edge 194 carrying the vacuum element 206. Means (not shown) are provided for reciprocating the blade 170 between the first 174 and second 178 positions to effect cutting of the tubing 154 at the pre-selected points.

Means (not shown) are provided for producing a vacuum in the vacuum element 206 when the blade 170 is moved to its second position 178 to cut the tubing 154 and abutting plastic strip 14, at which instant the adjacent area of the upper wall portion 142 of the gusset 46 is momentarily raised from its abutment with the plastic strip 14. Means (not shown) are provided for activating the adhesive injector 210 momentarily to discharge a pre-selected quantity of adhesive 214 in at least two locations between the raised upper wall portion 142 of the gusset 46 and the plastic strip 14 when the vacuum element 206 momentarily lifts the upper wall portion 142. Means 218 are provided adjacent the first side 186 of the blade 170 and in line with the raised upper portion 142 of the gusset 46, to compress the raised area of the gusset 46 back to the plane of the remaining portion of the cut blank 166 and against the plastic strip 14.

Means 290 are provided for cutting a U-shaped cut-out 114 commencing at the sealed top edge 38 of the bag blank 166 and extending downwardly toward the bottom edge 34 of the blank 166.

When the blade 170 is brought down against the tubing 154 to cut it transversely, the heating elements 282, 286 on the first 186 and second 190 sides of the blade 170 heat seal the cut bottom 34 and top edges 38 of the bags 278 and the plastic strip 14 on the first 186 and second 190 sides of the blade 170, and the vacuum element 206 on the second side 190 of the blade 170 momentarily lifts an area of the upper portion 142 of the gusset 46 spaced from the (edge of the) second side 190 of the blade. The adhesive injector 210 then discharges a pre-selected quantity of adhesive 214 in at least two locations between the raised area of the upper portion 142 of the gusset 46 and a portion of the plastic strip 14 between its first 50 and second 54 ends. Next, upon the raising of the blade 170 to its first position 174, the raised upper portion 142 of the gusset 46 is pressed back down against the plastic strip 14 to the plane of the cut blank 166, a U-shaped cut-out 114 is then cut in the bag blank 166 commencing at the sealed top edge 38 and extending downwardly toward the bottom edge 34, thus yielding an open mouth 294 and a pair of bag handles 278.

Figure 16:
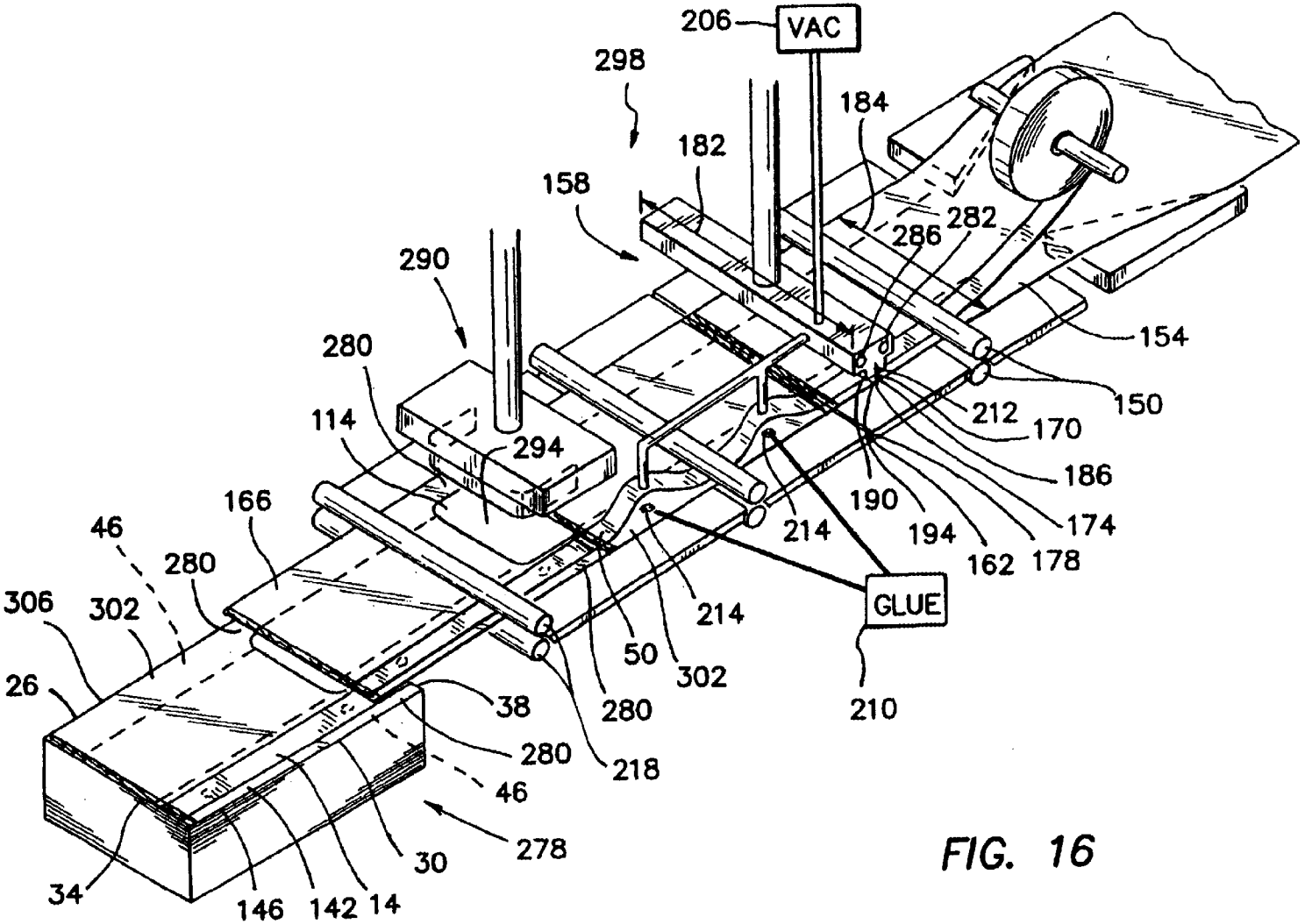
FIG. 16 is a perspective view of the bag making apparatus for forming the FIG. 8 bags.

Another variant of the apparatus 298, as illustrated in FIG. 16, is designed for fabricating plastic bags 278 each having front 302 and rear 306 outer surfaces, closed side 26,30 and bottom edges 34, first and second side gussets 46, a partially open top edge 38, and a pair of bag handles 280 terminating at the top edge 38. The gussets 46 are comprised of an upper wall portion 142 and a lower wall portion 146 in abutment with each other. A plastic strip 14 disposed upon at least one of the front 302 and rear 306 outer surfaces above at least one gusset 46.

The apparatus 298 includes means 150 for moving extruded flattened and gusseted plastic tubing 154 in a horizontal plane into a cutting station 158. The tubing 154 has a plastic strip 14 located upon at least one of the front 302 and rear 306 outer surfaces above at least one gusset 46. The station 158 has a horizontal planar blade receiving area 162 over which the flattened tubing 154 is moved to be cut into a series of rectangular blanks 166.

A blade 170 is provided for cutting the tubing 154 transversely at the cutting station 158 at pre-selected points along the tubing length to produce the series of blanks 166 of a predetermined length. The blade 170 is reciprocatable between a first upper poised position 174, and a second lower cutting position 178 on the planar blade receiving area 162. The blade 170 is of a length 182 at least as great as the width 184 of the gusseted tubing 154. The blade 170 has a first side 186 and a second side 190. The blade 170 further has a cutting edge 194 and carries first 282 and second 286 heating elements on its first 186 and second 190 sides adjacent the cutting edge 194. The heating elements 282, 286 serve to heat seal the cut bottom 34 and top edges 38 of the bags 278 including its gussets 46 and the plastic strip 14 (portion) on the first 186 and second 190 sides of the blade 170.

A vacuum element 206 is located on the second side 190 of the blade 170 and spaced from the second heating element 286 and above the upper wall portion 142 of the gusseted side edge 26, 30. The vacuum element 206, when the blade 170 is lowered to its second position 178, extending to at least one gusset 46 of the tubing 154. An adhesive injector 210 is located adjacent the side edge 212 of the blade 170 and proximate to the portion of the blade 170 (edge) carrying the vacuum element 206. Means (not shown) are provided for reciprocating the blade 170 between the first 174 and second 178 positions to effect cutting of the tubing 154 at the pre-selected points. Means (not shown) are provided for producing a vacuum in the vacuum element 206 when the blade 170 is moved to its second position 178 to cut the tubing 154 and abutting plastic strip 14. At this instant a portion of the plastic strip 14 disposed above the gusset 46 is momentarily raised from its abutment with either of the front 302 and rear 306 outer surfaces.

Means (not shown) are provided for activating the adhesive injector 210 momentarily to discharge a pre-selected quantity of adhesive 214 in at least two locations between the raised portion of the plastic strip 14 and either of the front 302 and rear 306 outer surfaces when the vacuum element 206 momentarily lifts the portion of the plastic strip 14. Means 218 are provided adjacent the first side 186 of the blade 170 and in line with the gusset 46, to compress the raised portion of the plastic strip 14 back to the plane of the cut blank 166. Means 290 are provided for cutting a U-shaped cut-out 114 commencing at the sealed top edge 38 of the bag 278 (blank) and extending downwardly toward the bottom edge 34 of the bag 278.

When the blade 170 is brought down against the tubing 154 to cut it transversely, the heating elements 282, 286 on the first 186 and second 190 side of the blade 170 heat seal the cut bottom 34 and top edges 38 of the bag 278 and the plastic strip 14 on the first 186 and second 190 sides of the blade 170. Next, the vacuum element 206 on the second side 190 of the blade 170 momentarily lifts a portion of the plastic strip 14 spaced from the (edge of the) second side 190 of the blade 170, and the adhesive injector 210 discharges a pre-selected quantity of adhesive 214 in at least two locations between the raised portion of the plastic strip 14 between its first 50 and second 54 end and either of the front 302 and 306 rear outer surfaces. Next, upon the raising of the blade 170 to its first position 174, the raised portion of the plastic strip 14 is pressed back down to the plane of the cut blank 166, a U-shaped cut-out 114 is then cut in the bag blank 166 commencing at the sealed top edge 38 and extending downwardly toward the bottom edge 34, thus yielding an open mouth 294 and a pair of bag handles 280.

Still another variant of the apparatus 310, as illustrated in FIG. 17, is designed for fabricating plastic shopping bags 10 each having closed side 26, 30 and bottom 34 edges, at least one gusseted side edge 26, 30, and an open top edge 38. The at least one gusseted side edge 26, 30 is comprised of an upper wall portion 142 and a lower wall portion 146 in abutment with each other, and a plastic strip 14 located between the upper 142 and lower 146 wall portions of the gusseted side edge 26, 30.

The apparatus 310 includes a roll 314 of plastic strip material 318. The strip material 318 has parallel first 322 and second 326 side edges and is mounted in an unwind stand 330. Means 332 are provided for unrolling the roll 314 of plastic strip material 318 from the unwind stand 330. A cold adhesive applicator 334 is provided. The applicator 334 is located to apply either a continuous or non-continuous bead of cold adhesive 338 between the first 322 and second 326 side edges of the plastic strip material 318. Means (not shown) are provided for activating the cold adhesive applicator 334 as the plastic strip material 318 is unrolled from the unwind stand 330.

Means 342 are provided for opening a gusset 46 in extruded flattened and gusseted plastic tubing 154 and feeding the plastic strip material 318 with applied cold adhesive 338 into the gusset 46. Means 150 are provided for closing the gusset 46 with the plastic strip material 318 located therein and compressing the plastic strip material 318 against the upper wall portion 142 and the lower wall portion 146 of the gusset 46, thereby adhering the strip material 318 to the upper 142 or lower 146 wall portions.

Means 150 also move the plastic tubing 154 in a horizontal plane into a cutting station 158. The station 158 has a horizontal planar blade receiving area 162 over which the flattened tubing 154 is moved to be cut into a series of rectangular blanks 166. A blade 170 is provided for cutting the tubing 154 transversely at the cutting station 158 at pre-selected points along the tubing length to produce the series of blanks 166 of a predetermined length. The blade 170 is reciprocatable between a first upper poised position 174, and a second lower cutting position 178 on the planar blade receiving area 162. The blade 170 is of a length 182 at least as great as the width 184 of the gusseted tubing 154. The blade 170 has a first side 186 and a second side 190. The blade 170 has a cutting edge 194 and carries a heating element 198 on its first side 186 adjacent the cutting edge 194.

The heating element 198 serves to heat seal the cut edge of the tubing 154 including its gusset 46 and enclosed plastic strip material 318 on the first side 186 of the blade 170. Means (not shown) are provided for reciprocating the blade 170 between the first 174 and second 178 positions to effect cutting of the tubing 154 at the pre-selected points.

When the plastic strip material 318 is located in the opened gusset 46, the gusset 46 is then closed and the upper 142 and lower 146 wall portions compressed against the strip material 318. The blade 170 is then brought down against the tubing 154 to cut it transversely, the heating element 198 on the first side of the blade 170 heat-seals the cut edge 202 of the tubing 154 on the first side 186 of the blade 170 , leaving an openable bag mouth 294 on the second side 190 of the blade 170. The plastic strip material 318 will thus be heat sealed into the bottom edge 34 of the bag 10 and the strip material 318 will be adhered within the gusset 46.

A further variant of the apparatus 350, as illustrated in FIG. 18, is designed for fabricating plastic bags 10, each having an open top edge 38, at least one gusseted side edge 26, 30 and a plastic strip 14 located along one side 230 of the gusseted side edge 26, 30. The apparatus 350 includes a roll 314 of plastic strip material 318, the strip material 318 has parallel first 322 and second 326 side edges and is mounted in an unwind stand 330. Means 332 are provided for unrolling the roll 314 of plastic strip material 318 from the unwind stand 330. A cold adhesive applicator 334 is provided. The applicator 334 is located to apply a continuous or non-continuous bead of cold adhesive 338 between the first 322 and second 326 side edges of the plastic strip material 318. Means (not shown) are provided for activating the cold adhesive applicator 334 as the plastic strip material 318 is unrolled from the unwind stand 330.

Means 354 are provided for locating the plastic strip material 318 with applied cold adhesive 338 along one side 230 of a gusseted side edge 26, 30 of extruded flattened and gusseted plastic tubing 154. Means 150 are provided for compressing the plastic strip material 318 against the tubing 154 thereby adhering the strip material 318 to the tubing 154 adjacent the gusseted side edge 26, 30. Means 150 also move flattened plastic tubing 154 in a horizontal plane into a cutting station 158. The station 158 has a horizontal planar blade receiving area 162 over which the flattened tubing 154 is moved to be cut into a series of rectangular blanks 166.

A blade 170 is provided for cutting the tubing 154 transversely at pre-selected points along its length to produce the series of blanks 166. The blade 170 is reciprocatable between a first upper poised position 174, and a second lower cutting position 178 on the planar blade receiving area 162. The blade 170 is of a length 182 at least as great as the width 184 of the gusseted tubing 154. The blade 170 has a first side 186 and a second side 190. The blade 170 further has a cutting edge 194 and carries a heating element 198 on its first side 186 adjacent the cutting edge 194. The heating element 198 serves to heat seal the cut edge 202 of the tubing 154 including its gusset 46 and the plastic strip material 318 located along one side of the gusseted side edge 26, 30 on the first side 186 of the blade 170. Means (not shown) are provided for reciprocating the blade 170 between the first 174 and second 178 positions to effect cutting of the tubing 154 at the pre-selected points.

When the plastic strip material 318 is located along one side 230 of the gusseted side edge 26, 30 and the plastic strip material 318 is compressed against the tubing 154 along one side 230 of the gusseted side edge 26, 30 and the blade 170 is brought down against the tubing 154 to cut it transversely, the heating element 198 on the first side 186 of the blade 170 heat-seals the cut edge 202 of the tubing 154 on the first side 186 of the blade 170, leaving an openable bag mouth 294 on the second side 190 of the blade 170, the plastic strip material 318 will be heat sealed into the bottom edge 34 of the bag 10 and the strip material 318 will be adhered above the gusset 46.

Yet another variant of the apparatus 362, as illustrated in FIG. 19, is designed for fabricating plastic shopping bags 10 each having closed side 26, 30 and bottom 34 edges, at least one gusseted side edge 26, 30, and an open top edge 38. The at least one gusseted side edge 26, 30 is comprised of an upper wall portion 142 and a lower wall portion 146 in abutment with each other, with a plastic strip 14 located between the upper 142 and lower 146 wall portions of the gusseted side edge 26, 30. The apparatus 362 includes a roll 314 of plastic strip material 318. The strip material 318 has parallel first 322 and second 326 side edges and is mounted in an unwind stand 330. Means 332 are provided for unrolling the roll 314 of plastic strip material 318 from the unwind stand 330. A cold adhesive applicator 334 is provided. The applicator 334 is located to apply a continuous or non-continuous bead of cold adhesive 338 between the first 322 and second 326 side edges of the plastic strip material 318. Means (not shown) are provided for activating the cold adhesive applicator 334 as the plastic strip material 318 is unrolled from the unwind stand 330.

Means 342 are provided for opening a gusset 46 in extruded flattened and gusseted plastic tubing 154 and inserting plastic strip material 318 of a predetermined length with applied cold adhesive 338 into the gusset 46. Means 150 are provided for closing the gusset 46 with the plastic strip material 318 located therein and compressing the plastic strip material 318 against the upper wall portion 142 and the lower wall portion 146 of the gusset 46, thereby adhering the strip material 318 to either of the upper 142 and lower 146 wall portions.

Means 150 also move extruded flattened and gusseted plastic tubing 154 in a horizontal plane into a cutting station 158. The station 158 has a horizontal planar blade receiving area 162 over which the flattened tubing 154 is moved to be cut into a series of rectangular blanks 166. A blade 170 is provided for cutting the tubing 154 transversely at the cutting station 158 at pre-selected points along the tubing length to produce the series of blanks 166 of a predetermined length. The blade 170 is reciprocatable between a first upper poised position 174, and a second lower cutting position 178 on the planar blade receiving area 162. The blade 170 is of a length 182 at least as great as the width 184 of the gusseted tubing 154. The blade 170 has a first side 186 and a second side 190. The blade 170 has a cutting edge 194 and carries a heating element 198 on its first side 186 adjacent the cutting edge 194.

The heating element 198 serves to heat seal the cut edge 202 of the tubing 154 including its gusset 46 on the first side 186 of the blade 170. Means (not shown) are provided for reciprocating the blade 170 between the first 174 and second 178 positions to effect cutting of the tubing 154 at the pre-selected points. When the predetermined length of plastic strip material 318 is located in the opened gusset 46 and the gusset 46 is then closed and the upper 142 and lower 146 wall portions compressed against the strip material 318 and the blade 170 is brought down against the tubing 154 to cut it transversely, the heating element 198 on the first side 186 of the blade 170 heat-seals the cut edge 202 of the tubing 154 on the first side 186 of the blade 170 , leaving an openable bag mouth 294 on the second side 190 of the blade 170, the plastic strip material 318 will be adhered within the gusset 46.

Yet a further apparatus 366, as illustrated in FIG. 20, is designed for fabricating plastic bags 10 each having an open top edge 38, at least one gusseted side edge 26, 30 and a plastic strip 14 located along one side 230 of the gusseted side edge 26, 30. The apparatus 366 includes a roll 314 of plastic strip material 318. The strip material 318 has parallel first 322 and second 326 side edges and is mounted in an unwind stand 330. Means 332 are provided for unrolling the roll of plastic strip material 318 from the unwind stand 330. A cold adhesive applicator 334 is provided. The applicator 334 is located to apply either a continuous or non-continuous bead of cold adhesive 338 between the first 322 and second 326 side edges of the plastic strip material 318. Means (not shown) are provided for activating the cold adhesive applicator 334 as the plastic strip material 318 is unrolled from the unwind stand 330.

Means 354 are provided for locating plastic strip material 318 of a predetermined length with applied cold adhesive 338 along one side of a gusseted side edge 26, 30 of extruded flattened and gusseted plastic tubing 154. Means 150 are provided for compressing the plastic strip material 318 against the tubing 154 thereby adhering the strip material 318 adjacent the gusseted side edge 26, 30. Means 150 also move flattened plastic tubing 154 in a horizontal plane into a cutting station 158. The station 158 has a horizontal planar blade receiving area 162 over which the flattened tubing 154 is moved to be cut into a series of rectangular blanks 166. The tubing 154 is gusseted along at least one side edge 26, 30.

A blade 170 is provided for cutting the tubing 154 transversely at pre-selected points along its length to produce the series of blanks 166. The blade 170 is reciprocatable between a first upper poised position 174, and a second lower cutting position 178 on the planar blade receiving area 162. The blade 170 is of a length 182 at least as great as the width 184 of the gusseted tubing 154. The blade 170 has a first side 186 and a second side 190, the blade 170 further has a cutting edge 194 and carries a heating element 198 on its first side 186 adjacent the cutting edge 194. The heating element 198 serving to heat seal the cut edge 202 of the tubing 154 including its gusset 46 on the first side 186 of the blade 170.

When the plastic strip material 318 is located along one side 230 of the gusseted side edge 26, 30 and the plastic strip material 318 is compressed against the tubing 154 and the blade 170 is brought down against the tubing 154 to cut it transversely, the heating element 198 on the first side 186 of the blade 170 heat-seals the cut edge 202 of the tubing 154 on the first side 186 of the blade 170, leaving an openable bag mouth 294 on the second side 190 of the blade 170, the plastic strip material 318 will be adhered above the gusset 46.

Still a further variant of an apparatus 370, as illustrated in FIG. 21, is designed for fabricating plastic bags 258 each having an open top edge 38 and a plastic strip 14 located upon at least one of the front 18 and back 22 walls between the side edges 26, 30. The apparatus 370 includes a roll 314 of plastic strip material 318. The strip material 318 has parallel first 322 and second 326 side edges and is mounted in an unwind stand 330. Means 332 are provided for unrolling the roll 314 of plastic strip material 318 from the unwind stand 330. A cold adhesive applicator 334 is provided. The applicator 334 is located to apply either a continuous or non-continuous bead of cold adhesive 338 between the first 322 and second 326 side edges of the plastic strip material 318. Means (not shown) are provided for activating the cold adhesive applicator 334 as the plastic strip material 318 is unrolled from the unwind stand 330. Means 374 are provided for locating plastic strip material 318 with applied cold adhesive 338 upon either of front 18 and back 22 walls and between side edges 26, 30 of extruded flattened plastic tubing 262. Means 150 are provided for compressing the plastic strip material 318 against either the front 18 or back 22 walls thereby adhering the strip material 318 to either of the walls 18, 22.

Means 150 also move flattened plastic tubing 154 in a horizontal plane into a cutting station 158. The station 158 has a horizontal planar blade receiving area 162 over which the flattened tubing 262 is moved to be cut into a series of rectangular blanks 166.

A blade 170 is provided for cutting the tubing 262 transversely at pre-selected points along its length to produce the series of blanks 166. The blade 170 is reciprocatable between a first upper poised position 174, and a second lower cutting position 178 on the planar blade receiving area 162. The blade 170 is of a length 182 at least as great as the width 184 of the tubing 262. The blade 170 has a first side 186 and a second side 190. The blade 170 further has a cutting edge 194 and carries a heating element 198 on its first side 186 adjacent the cutting edge 194.

The heating element 198 serves to heat seal the cut edge 202 of the tubing 262 and the plastic strip material 318 located upon at least one of the front 18 and back 22 walls between the side edges 26, 30 on the first side 186 of the blade 170. Means (not shown) are provided for reciprocating the blade 170 between the first 174 and second 178 positions to effect cutting of the tubing 262 at the pre-selected points.

When the plastic strip material 318 is located upon either of the front 18 and back 22 walls between the side edges 26, 30 of the tubing 262 and the plastic strip material 318 is compressed against the tubing 262 and the blade 170 is brought down against the tubing 262 to cut it transversely, the heating element 198 on the first side 186 of the blade 170 heat-seals the cut edge 202 of the tubing 262 on the first side 186 of the blade 170, leaving an openable bag mouth 294 on the second side 190 of the blade 170, the plastic strip material 318 will be heat sealed into the bottom edge 34 of the bag 258 and the strip material 318 will be adhered to either of the front 18 and back 22 walls.

Another variant of an apparatus 382, as illustrated in FIG. 22, is designed for fabricating plastic bags 258 each having an open top edge 38 and a plastic strip upon 14 at least one of the front 18 and back 22 walls between the side edges 26, 30. The apparatus 382 includes a roll 314 of plastic strip material 318. The strip material 318 has parallel first 322 and second 326 side edges and is mounted in an unwind stand 330. Means 332 are provided for unrolling the roll 314 of plastic strip material 318 from the unwind stand 330. A cold adhesive applicator 334 is provided. The applicator 334 is located to apply either a continuous or non-continuous bead of cold adhesive 338 between the first 322 and second 326 side edges of the plastic strip material 318. Means (not shown) for activating the cold adhesive applicator 338 as the plastic strip material 318 is unrolled from the unwind stand 330.

Means 386 are provided for locating plastic strip material 318 of a predetermined length with applied cold adhesive 338 upon either front 18 or back 22 walls and between side edges 26, 30 of extruded flattened plastic tubing 262. Means 150 are provided for compressing the plastic strip material 318 against either the front 18 or back 22 walls thereby adhering the strip material 318 to either of the walls 18, 22. Means 150 also move flattened plastic tubing 262 in a horizontal plane into a cutting station 158. The station 158 has a horizontal planar blade receiving area 162 over which the flattened tubing 262 is moved to be cut into a series of rectangular blanks 166.

A blade 170 is provided for cutting the tubing 262 transversely at pre-selected points along its length to produce the series of blanks 166. The blade 170 is reciprocatable between a first upper poised position 174, and a second lower cutting position 178 on the planar blade receiving area 162. The blade 170 is of a length 182 at least as great as the width 184 of the tubing 262. The blade 170 has a first side 186 and a second side 190. The blade 170 further has a cutting edge 194 and carries a heating element 198 on its first side 186 adjacent the cutting edge 194. The heating element 198 serves to heat seal the cut edge 202 of the tubing 262 on the first side 186 of the blade 170.

When the plastic strip material 318 is located upon either of the front 18 and back 22 walls between the side edges 26, 30 and the plastic strip material 318 is compressed against the tubing 262 and the blade 170 is brought down against the tubing 262 to cut it transversely, the heating element 198 on the first side 186 of the blade 170 heat-seals the cut edge 202 of the tubing 262 on the first side 186 of the blade 170, leaving an openable bag mouth 294 on the second side 190 of the blade 170, the plastic strip material 318 will be adhered to either of the front 18 and back 22walls.

Still another variant of an apparatus 394, as illustrated in FIG. 23, is designed for fabricating plastic shopping bags 278 each having closed side 26, 30 and bottom edges 34, first and second side gussets 46, a partially open top edge 38, and a pair of bag handles 280 terminating at the top edge 38. The gussets 46 are comprised of an upper wall portion 142 and a lower wall portion 146 in abutment with each other. A plastic strip 14 is located between the upper 142 and lower 146 wall portions of at least one gusset 46.

The apparatus 394 includes a roll 314 of plastic strip material 318. The strip material 318 has parallel first 322 and second 326 side edges and is mounted in an unwind stand 330. Means 332 are provided for unrolling the roll 314 of plastic strip material 318 from the unwind stand 330. A cold adhesive applicator 334 is provided. The applicator 334 is located to apply either a continuous or non-continuous bead of cold adhesive 338 between the first 322 and second 336 side edges of the plastic strip material 318. Means (not shown) are provided for activating the cold adhesive applicator 334 as the plastic strip material 318 is unrolled from the unwind stand 330. Means 342 are provided for opening a gusset 46 in extruded flattened and gusseted plastic tubing 154 and feeding the plastic strip material 318 with applied cold adhesive 338 into the gusset 46. Means 150 are provided for closing the gusset 46 with the plastic strip material 318 located therein and compressing the plastic strip material 318 against the upper wall portion 142 and the lower wall portion 146 of the gusset 46, thereby adhering the strip material 318 to either of the upper 142 and lower 146 wall portions.

Means 150 also move extruded flattened and gusseted plastic tubing 154 having plastic strip material 318 located in at least one of the gussets 46, in a horizontal plane into a cutting station 158. The station 158 has a horizontal planar blade receiving area 162 over which the flattened tubing 154 is moved to be cut into a series of rectangular blanks 166.

A blade 170 is provided for cutting the tubing 154 transversely at the cutting station 158 at pre-selected points along the tubing length to produce the series of blanks 166 of a predetermined length. The blade 170 is reciprocatable between a first upper poised position 174, and a second lower cutting position 178 on the planar blade receiving area 162. The blade 170 is of a length 182 at least as great as the width 184 of the gusseted tubing 154. The blade 170 has a first side 186 and a second side 190. The blade 170 further has a cutting edge 194 and carries first 282 and second 286 heating elements on its first 186 and second 190 sides adjacent the cutting edge 194.

The heating elements 282, 286 serve to heat seal the cut bottom 34 and top 38 edges of the bag 278 including its gussets 46 and enclosed plastic strip material 318 on the first 186 and second 190 sides of the blade. Means (not shown) are provided for reciprocating the blade 170 between the first 174 and second 178 positions to effect cutting of the tubing 154 at the pre-selected points. Means 290 are provided for cutting a U-shaped cut-out 114 commencing at the sealed top edge 38 of the bag blank 166 and extending downwardly toward the bottom edge 34 of the blank 166.

When the plastic strip material 318 is located in the opened gusset 46 and the gusset 46 is then closed and the upper 142 and lower 146 wall portions compressed against the strip material 318 and when the blade 170 is brought down against the tubing 154 to cut it transversely, the heating elements 282, 286 on the first 186 and second 190 sides of the blade 170 heat seal the cut bottom 34 and top 38 edges of the bag 278 and the plastic strip material 318 on the first 186 and second 190 sides of the blade 170, the plastic strip material 318 will be heat sealed into the top 38 and bottom 34 edges of the bag 278 and the strip material 318 will be adhered within the gusset 46, a U-shaped cut-out 114 is then cut in the bag blank 166 commencing at the sealed top edge 38 and extending downwardly toward the bottom edge 34, thus yielding an open mouth 294 and a pair of bag handles 280.

A final variant of an apparatus 398, as illustrated in FIG. 24, is designed for fabricating plastic shopping bags 278 each having front 302 and rear 306 outer surfaces, closed side 26, 30 and bottom edges 34, first and second side gussets 46, a partially open top edge 38, and a pair of bag handles 280 terminating at the top edge 38. The gussets 46 are comprised of an upper wall portion 142 and a lower wall portion 146 in abutment with each other, and a plastic strip 14 located upon at least one of the front 302 and rear 306 outer surfaces above at least one gusset 46.

The apparatus 398 includes a roll 314 of plastic strip material 318. The strip material 318 has parallel first 322 and second 326 side edges and is mounted in an unwind stand 330. Means 332 are provided for unrolling the roll 314 of plastic strip material 318 from the unwind stand 330. A cold adhesive applicator 334 is provided. The applicator 334 is located to apply either a continuous or non-continuous bead of cold adhesive 338 between the first 322 and second 326 side edges of the plastic strip material 318. Means (not shown) are provided for activating the cold adhesive applicator 334 as the plastic strip material 318 is unrolled from the unwind stand 330.

Means 402 are provided for locating the plastic strip material 318 with applied cold adhesive 338 along one side 230 of a gusseted side edge 26, 30 of extruded flattened and gusseted plastic tubing 154. Means 358 are provided for compressing the plastic strip material 318 against the tubing thereby adhering the strip material 318 adjacent the gusseted side edge 26, 30.

Means 150 are provided for moving extruded flattened and gusseted plastic tubing 154 having plastic strip material 318 located upon at least one of the front 302 and rear 306 outer surfaces above at least one gusset 46, in a horizontal plane into a cutting station 158, the station having a horizontal planar blade receiving area 162 over which the flattened tubing 154 is moved to be cut into a series of rectangular blanks 166.

A blade 170 is provided for cutting the tubing 154 transversely at the cutting station 158 at pre-selected points along the tubing length to produce the series of blanks 166 of a predetermined length. The blade 170 is reciprocatable between a first upper poised position 174, and a second lower cutting position 178 on the planar blade receiving area 162. The blade 170 is of a length 182 at least as great as the width 184 of the gusseted tubing 154. The blade 170 has a first side 186 and a second side 190. The blade 170 further has a cutting edge 194 and carries first 282 and second 286 heating elements on its first 186 and second 190 sides adjacent the cutting edge 194. The heating elements 282, 286 serves to heat seal the cut bottom 34 and top 38 edges of the bag 278 including its gussets 46 and the plastic strip material 318 on the first 186 and second 190 sides of the blade 190. Means (not shown) are provided for reciprocating the blade 170 between the first 174 and second 178 positions to effect cutting of the tubing 154 at the pre-selected points.

Means 290 are provided for cutting a U-shaped cut-out 114 commencing at the sealed top edge 38 of the bag blank 166 and extending downwardly toward the bottom edge 34 of the blank 166. When the plastic strip material 318 is located above the gusset 46 and the plastic strip material 318 is then compressed against the tubing 154 and when the blade 170 is brought down against the tubing 154 to cut it transversely, the heating elements 282, 286 on the first 186 and second 190 sides of the blade 170 heat seal the cut bottom 34 and top 38 edges of the bag 278 and the plastic strip material 318 on the first 186 and second 190 sides of the blade 170, the plastic strip material 318 will be heat sealed into the top 38 and bottom 34 edges of the bag 278 and the strip material 318 will be adhered above the gusset 46, a U-shaped cut-out 114 is then cut in the bag blank 166 commencing at the sealed top edge 38 and extending downwardly toward the bottom edge 34, thus yielding an open mouth 130 and a pair of bag handles 280.

The plastic shopping bags 10, 278 with promotional strip ad and method and apparatus for making same have been described with reference to particular embodiments. Other modifications and enhancements can be made without departing from the spirit and scope of the claims that follow.

What is claimed is:

1. A plastic shopping bag comprising:

a pair of registering front and back walls, said walls being secured together along their side and bottom edges and open across at least a portion of their top edges;

said walls, when pulled apart from each other, defining a space into which articles may be placed;

a plastic strip disposed upon at least one of the front and back walls between the side edges, said strip having a first end and a second end and being of a length not greater than a length of the walls;

said first end of said strip being heat sealed to the bottom edges of the bag walls and the second end of the strip being adhered in the vicinity of the top edges of the bag walls;

promotional material, said promotional material being printed upon at least one of an upper surface and a lower surface of said portion of said strip between its first and second ends that is removably attached to the remainder of the strip; and at least a portion of said strip between its first and second ends being detachable from the remainder of the strip and removable from the bag walls.

2. A plastic shopping bag, as described in claim 1, wherein the portion of the strip between its first and second ends is removably attached to the remainder of the strip with at least two perforation lines.

3. A plastic shopping bag comprising:

a pair of registering front and back walls, said walls being secured together along their side and bottom edges and open across at least a portion of their top edges;

said walls, when pulled apart from each other, defining a space into which articles may be placed;

a plastic strip, said plastic strip having first and second remainder portions disposed at either end of said strip and a removable portion disposed between said remainder portions;

said strip being heat sealed to the bottom edge of the bag wall at an end of said first remainder portion and having said second remainder portion adhered in the vicinity of the top edge of the bag wall.

4. A plastic shopping bag, as described in claim 3, wherein said removable portion of the strip is removably attached to said first remainder portion with at least one perforation line and is removably attached to said second remainder portion with at least one perforation line.

5. A plastic shopping bag, as described in claim 3, wherein promotional material is printed upon at least one of an upper surface and a lower surface of said removable portion of said strip.

* * * * *